US010023940B2

(12) United States Patent
Maehara et al.

(10) Patent No.: US 10,023,940 B2
(45) Date of Patent: Jul. 17, 2018

(54) COPPER ALLOY AND PROCESS FOR PRODUCING THE SAME

(75) Inventors: Yasuhiro Maehara, Osaka (JP); Mitsuharu Yonemura, Osaka (JP); Takashi Maeda, Osaka (JP); Keiji Nakajima, Osaka (JP); Tsuneaki Nagamichi, Osaka (JP)

(73) Assignee: NIPPON STEEL & SUMITOMO METAL CORPORATION, Chiyoda-Ku, Tokyo (JP)

( * ) Notice: Subject to any disclaimer, the term of this patent is extended or adjusted under 35 U.S.C. 154(b) by 1845 days.

(21) Appl. No.: 11/378,646

(22) Filed: Mar. 20, 2006

(65) Prior Publication Data

US 2006/0239853 A1 Oct. 26, 2006

Related U.S. Application Data

(63) Continuation of application No. PCT/JP2004/013439, filed on Sep. 15, 2004.

(30) Foreign Application Priority Data

Sep. 19, 2003 (JP) ..... 2003-328946
Mar. 1, 2004 (JP) ..... 2004-056903
Aug. 11, 2004 (JP) ..... 2004-234851

(51) Int. Cl.
*C22C 9/00* (2006.01)
*C22F 1/00* (2006.01)
(Continued)

(52) U.S. Cl.
CPC ..... *C22C 9/00* (2013.01); *B22D 21/025* (2013.01); *B22D 23/006* (2013.01); *C22F 1/002* (2013.01); *C22F 1/08* (2013.01)

(58) Field of Classification Search
CPC ..... C22C 9/00; B22D 23/006; B22D 21/025; C22F 1/002; C22F 1/08
(Continued)

(56) References Cited

U.S. PATENT DOCUMENTS 4,589,930 A * 5/1986 Kumagai ..... C22C 9/00 148/411
4,594,221 A 6/1986 Caron et al.
(Continued)

FOREIGN PATENT DOCUMENTS

EP 0485627 A1 5/1992
EP 1264905 A2 12/2002
(Continued)

*Primary Examiner* — Keith Walker
*Assistant Examiner* — John A Hevey
(74) *Attorney, Agent, or Firm* — Buchanan, Ingersoll & Rooney PC

(57) ABSTRACT

A copper alloy consisting of two or more of Cr, Ti and Zr, and the balance Cu and impurities, in which the relationship between the total number N and the diameter X satisfies the following formula (1). Ag, P, Mg or the like may be included instead of a part of Cu. This copper alloy is obtained by cooling a bloom, a slab, a billet, or a ingot in at least in a temperature range from the bloom, the slab, the billet, or the ingot temperature just after casting to 450° C., at a cooling rate of 0.5° C./s or more. After the cooling, working in a temperature range of 600° C. or lower and further heat treatment of holding for 30 seconds or more in a temperature range of 150 to 750° C. are desirably performed. The working and the heat treatment are most desirably performed for a plurality of times.

$$\log N \leq 0.4742 + 17.629 \times \exp(-0.1133 \times X) \quad (1)$$

9 Claims, 4 Drawing Sheets

(51) Int. Cl.

| | |
|---|---|
| ***B22D 21/02*** | (2006.01) |
| ***C22F 1/08*** | (2006.01) |
| ***B22D 23/00*** | (2006.01) |

(58) Field of Classification Search
USPC ..... 148/432; 420/492
See application file for complete search history.

(56) References Cited

U.S. PATENT DOCUMENTS

| | | | | |
|---|---|---|---|---|
| 4,640,723 | A * | 2/1987 | Sugai | C22C 9/00 148/411 |
| 5,705,125 | A | 1/1998 | Goto et al. | |
| 6,565,681 | B1 | 5/2003 | Gravemann et al. | |

FOREIGN PATENT DOCUMENTS

| | | | |
|---|---|---|---|
| JP | 59-193233 | A | 11/1984 |
| JP | 63-303020 | A | 12/1988 |
| JP | 02-170932 | A | 7/1990 |
| JP | 2572042 | B2 | 10/1996 |
| JP | 09-78162 | A | 3/1997 |
| JP | 2714561 | B2 | 11/1997 |
| JP | 2002-285261 | A | 10/2002 |

* cited by examiner

COPPER ALLOY AND PROCESS FOR PRODUCING THE SAME

The disclosure of Japan Patent Application No. 2003-328946 filed Sep. 19th 2003, Japan Patent Application No. 2004-056903 filed Mar. 1st 2004 and Japan Patent Application No. 2004-234851 filed Aug. 11th 2004 including specification, drawings and claims is incorporated herein by reference in its entirety.

BACKGROUND

1. Field

Disclosed herein is a copper alloy which does not contain an element which has an adverse environmental effect such as Be, and a process for producing the same. This copper alloy is suitable for electrical and electronic parts, safety tools, and the like.

2. Description of Related Art

Examples of the electric and electronic parts include connectors for personal computers, semiconductor plugs, optical pickups, coaxial connectors, IC checker pins and the like in the electronics field; cellular phone parts (connector, battery terminal, antenna part), submarine relay casings, exchanger connectors and the like in the communication field; and various electric parts such as relays, various switches, micromotors, diaphragms, and various terminals in the automotive field; medical connectors, industrial connectors and the like in the medical and analytical instrument field; and air conditioners, home appliance relays, game machine optical pickups, card media connectors and the like in the electric home appliance field.

Examples of the safety tools include excavating rods and tools such as spanner, chain block, hammer, driver, cutting pliers, and nippers, which are used where a possible spark explosion hazard may take place, for example, in an ammunition chamber, a coal mine, or the like.

A Cu—Be alloy, known as a copper alloy is used for the above-mentioned electric and electronic parts. This alloy is strengthened by age precipitation of the Be, and contains a substantial amount of Be. This alloy has been extensively used as a spring material or the like because it is excellent in both tensile strength and electric conductivity. However, Be oxide is generated in the production process of Cu—Be alloy and also in the process of forming to various parts.

Be is an environmentally harmful material as is Pd and Cd. Particularly, intermetallics of a substantial amount of Be in the conventional Cu—Be alloy necessitates a treatment process for the Be oxide in the production and working of the copper alloy because it leads to an increase in the production cost. It also causes a problem in the recycling process of the electric and electronic parts because the Cu—Be alloy is a problematic material from the environmental point of view. Therefore, the emergence of a material, excellent in both tensile strength and electric conductivity, without containing environmentally harmful elements such as Be is desired.

It is very difficult to simultaneously enhance both the tensile strength [TS (MPa)] and the electric conductivity [relative value of annealed copper polycrystalline material to conductivity, IACS (%)]. Therefore, the end user frequently requests a concentrate with either of these characteristics.

This is also shown in Non-Patent Literature 1 describing various characteristics of practically produced copper and brass products.

FIG. 1 shows the relation between tensile strength and electric conductivity of copper alloys free from harmful elements such as Be described in Non-Patent Literature 1. As shown in FIG. 1, in conventional copper alloys free from harmful elements such as Be, for example, the tensile strength is as low as about 250-650 MPa in an area with a electric conductivity of 60% or more, and the electric conductivity is as low as less than 20% in an area with a tensile strength of 700 MPa or more. Most of the conventional copper alloys are high in either tensile strength (MPa) or the electric conductivity (%). Further, there is no high-strength alloy with a tensile strength of 1 GPa or more.

For example, a copper alloy called Corson alloy, in which $Ni_2Si$ is precipitated, is proposed in Patent Literature 1. This alloy has a relatively good balance of tensile strength and electric conductivity among alloys free from environmentally harmful elements such as Be, and has a electric conductivity of about 40% at a tensile strength of 750-820 MPa.

However, this alloy has limitations in enhancing strength and electric conductivity, and this still leaves a problem from the point of product variations as described below. This alloy has age hardenability due to the precipitation of $Ni_2Si$. If the electric conductivity is enhanced by reducing the contents of Ni and Si, the tensile strength is significantly reduced. On the other hand, even if the contents of Ni and Si are increased in order to raise the precipitation quantity of $Ni_2Si$, the electric conductivity is seriously reduced since the rise of tensile strength is limited. Therefore, the balance between tensile strength and electric conductivity of the Corson alloys is disrupted in an area with high tensile strength and in an area with high electric conductivity, consequently narrowing the product variations. This is explained as follows.

The electric resistance (or electric conductivity that is the inverse thereof) of this alloy is determined by electron scattering, and fluctuates depending on the kinds of elements dissolved in the alloy. Since the Ni dissolved in the alloy noticeably raises the electric resistance value (noticeably reduces the electric conductivity), the electric conductivity reduces in the above-mentioned Corson alloy if Ni is increased. On the other hand, the tensile strength of the copper alloy is obtained due to an age hardening effect. The tensile strength is improved more as the quantity of precipitates grows larger, or as the precipitates are dispersed more finely. The Corson alloy has limitations in enhancing the strength from the point of the precipitation quantity and from the point of the dispersing state, since the precipitated particle is made up of $Ni_2Si$ only.

Patent Literature 2 discloses a copper alloy with a satisfactory wire bonding property, which contains elements such as Cr and Zr and has a regulated surface hardness and surface roughness. As described in an embodiment thereof, this alloy is produced based on hot rolling and solution treatment.

However, the hot rolling needs a surface treatment for preventing hot cracking or removing scales, which result in a reduction in yield. Further, frequent heating in the atmosphere facilitates oxidation of active additive elements such as Si, Mg and Al. Therefore, the generated coarse internal oxides problematically s cause deterioration of characteristics of the final product. Further, the hot rolling and solution treatment need an enormous amount of energy. The copper alloy described in the cited literature 2 thus has problems in view of an addition in production cost and energy saving, furthermore, deterioration of product characteristics (bending workability, fatigue characteristic and the like besides tensile strength and electric conductivity), which is result of generation of coarse oxides and the like, because this alloy is based on the hot working and solution treatment.

FIGS. 2, 3 and 4 are a Ti—Cr binary system state view, a Cr—Zr binary system state view and a Zr—Ti binary system state view, respectively. It is apparent from these figures, the Ti—Cr, Cr—Zr or Zr—Ti compounds tend to formed, in a high temperature range after solidification in a copper alloy containing Ti, Cr or Zr. These compounds inhibit fine precipitation of $Cu_4Ti$, $Cu_9Zr_2$, $ZrCr_2$, metal Cr or metal Zr which is effective for precipitation strengthening. In other words, only a material insufficiently strengthened by precipitation with poor ductility or toughness can be obtained from a copper alloy produced through a hot process such as hot rolling. This also shows that the copper alloy described in Patent Literature 2 has a problem in the product characteristics.

On the other hand, the safety tool materials have required mechanical properties, for example, strength and wear resistance matching those of tool steel. It is also required to avoid generating sparks which could cause an explosion i.e. excellent spark generation resistance is necessary. Therefore, a copper alloy with high thermal conductivity, particularly, a Cu—Be alloy aimed at strengthening by age precipitation of Be has been extensively used. Although the Cu—Be alloy is an environmentally problematic material, as described above, it has been heavily used as the safety tool material based on the following.

FIG. 5 is a view showing the relation between electric conductivity [IACS (%)] and thermal conductivity [TC (W/m·K)] of a copper alloy. As shown in FIG. 5, both are almost in a 1:1-relation, which enhances the electric conductivity [IACS (%)] which is the same as enhancing the thermal conductivity [TC (W/m·K)], in other words, it enhances the spark generation resistance. Sparks are generated by the application of a sudden force by an impact blow or the like during the use of a tool due to a specified component in the alloy being burnt by the heat generated by an impact or the like. As described in Non-Patent Literature 2, steel tends to cause a local temperature rise due to its thermal conductivity which can be as low as ⅕ or less of that of Cu. Since the steel contains C, a reaction "$C+O_2 \rightarrow CO_2$" takes place, generating sparks. In fact, it is known that pure iron containing no C generates no sparks. Other metals which tend to generate sparks are Ti and Ti alloy. The thermal conductivity of Ti is as extremely low, as low as 1/20 of that of Cu, and therefore the reaction "$Ti+O_2$ to $TiO_2$" takes place. Data shown in Non-Patent Literature 1 are summarized in FIG. 5.

However, the electric conductivity [IACS (%)] and the tensile strength [TS (MPa)] are in a trade-off relation, and it is extremely difficult to enhance both simultaneously. Therefore, the Cu—Be alloy was the only copper alloy that had sufficiently high thermal conductivity TC while retaining a tool steel-level high tensile strength in the past.

Patent Literature 1:
Japanese Patent No. 2572042
Patent Literature 2:
Japanese Patent No. 2714561
Non-Patent Literature 1:
Copper and Copper Alloy Product Data Book, Aug. 1, 1997, issued by Japan Copper and Brass Association, pp. 328-355
Non-Patent Literature 2:
Industrial Heating, Vol. 36, No. 3 (1999), Japan Industrial Furnace Manufacturers Association, p. 59

SUMMARY

It is the primary objective of the present disclosure to provide a copper alloy, free from environmentally harmful elements such as Be, which is excellent in high-temperature strength, ductility and workability with a wide production variations and, further, excellent in performances required for safety tool materials, or thermal conductivity, wear resistance and spark generation resistance. It is the second objective of the present disclosure to provide a method for producing the above-mentioned copper alloy.

The "wide production variations" mean that the balance between electric conductivity and tensile strength can be adjusted from a high level equal to or higher than that of a Be-added copper alloy to a low level equal to that of a conventionally known copper alloy, by minutely adjusting addition quantities and/or a production condition.

The "the balance between electric conductivity and tensile strength can be adjusted from a high level equal to or higher than that of a Be-added copper alloy to a low level equal to that of a conventionally known copper alloy" specifically means a state satisfying the following formula (a). This state is hereinafter referred to a "state with an extremely satisfactory balance of tensile strength and electric conductivity".

$$TS \geq 648.06+985.48 \times \exp(-0.0513 \times IACS) \quad (a)$$

wherein TS represents tensile strength (MPa) and IACS represents electric conductivity (%).

In addition to the characteristics of the tensile strength and the electric conductivity as described above, a certain degree of high-temperature strength is also required for the copper alloy, because a connector material, used for automobiles and computers for example, is often exposed to an environment of 200° C. or higher. Although the room-temperature strength of pure Cu is excessively reduced in order to keep a desired spring property when heated to 200° C. or higher, the room-temperature strength of the above-mentioned Cu—Be alloy or Corson alloy is hardly reduced even if heated to 400° C.

Accordingly, high-temperature strength is necessary to ensure a level equal to or higher than that of Cu—Be alloy. Concretely, a heating temperature, where the reduction rate of hardness before and after a heating test is 50%, is defined as a heat resisting temperature. A heat resisting temperature exceeding 350° C. is regarded as excellent high temperature strength. A more preferable heat resisting temperature is 400° C. or higher.

For the bending workability, it is also necessary to ensure a level equal to that of a conventional alloy such as Cu—Be alloy. Specifically, the bending workability can be evaluated by performing a 90°-bending test to a specimen at various curvature radiuses, measuring a minimum curvature radius R, never causing cracking, and determining the ratio B (=R/t) of this radius to the plate thickness t. A satisfactory range of bending workability satisfies $B \leq 2.0$ in a plate material with a tensile strength TS of 800 MPa or less, which satisfies the following formula (b) in a plate material having a tensile strength TS exceeding 800 MPa.

$$B \leq 41.2686-39.4583 \times \exp[-\{(TS-615.675)/2358.08\}^2] \quad (b)$$

For a copper alloy as safety tool, wear resistance is also required in addition to other characteristics such as tensile strength TS and electric conductivity IACS as described above. Therefore, it is necessary to ensure that wear resistance is equal to that of tool steel. Specifically, a hardness at a room temperature of 250 or more by the Vickers hardness is regarded as excellent wear resistance.

Disclosed herein a copper alloy shown in (1) and a method for producing a copper alloy shown in (2), below.

(1) A copper alloy characterized by the following (A)-1 and (B):

(A)-1 The alloy consists of, by mass %, at least two elements selected from the following group (a) and the balance Cu and impurities;

group (a): 0.01 to 5% each of Cr, Ti and Zr (B) The relationship between the total number N and the diameter X satisfies the following formula (1):

$$\log N \leq 0.4742 + 17.629 \times \exp(-0.1133 \times X) \quad (1)$$

wherein N means the total number of precipitates and intermetallics, having a diameter of not smaller than 1 μm, which are found in 1 $mm^2$ of the alloy; and X means the diameter in μm of the precipitates and the intermetallics having a diameter of not smaller than 1 μm.

This copper alloy may, instead of a part of Cu, contain, 0.01 to 5% of Ag, 5% or less in total of one or more elements selected from the following groups (b), (c) and (d), 0.001 to 2% in total of one or more elements selected from the following group (e), and/or 0.001 to 0.3% in total of one or more elements selected from the following group (f).

group (b): 0.001 to 0.5% each of P, S, As, Pb and B group (c): 0.01 to 5% each of Sn, Mn, Fe, Co, Al, Si, Nb, Ta, Mo, V, W and Ge group (d): 0.01 to 3% each of Zn, Ni, Te, Cd and Se group (e): Mg, Li, Ca and rare earth elements group (f): Bi, Tl, Rb, Cs, Sr, Ba, Tc, Re, Os, Rh, In, Pd, Po, Sb, Hf, Au, Pt and Ga In these alloys, it is desirable that the ratio of a maximum value and a minimum value of the average content of at least one alloy element in a micro area is not less than 1.5. The grain size of the alloy is desirably 0.01 to 35 μm.

(2) A method for producing a copper alloy, comprising cooling a bloom, a slab, a billet, or a ingot obtained by melting a copper alloy, having a chemical composition described in the above (1), followed by casting in at least in a temperature range from the bloom, the slab, the billet, or the ingot temperature just after casting to 450° C., at a cooling rate of 0.5° C./s or more, in which the relationship between the total number N and the diameter X satisfies the following formula (1):

$$\log N \leq 0.4742 + 17.629 \times \exp(-0.1133 \times X) \quad (1)$$

wherein N means the total number of precipitates and intermetallics, having diameter of not smaller than 1 μm which are found in 1 $mm^2$ of the alloy; and X means the diameter in μm of the precipitates and the intermetallics having a diameter of not smaller than 1 μM.

After the cooling, working in a temperature range of 600° C. or lower, and a further heat treatment holding for 30 seconds or more in a temperature range of 150 to 750° C. are desirably performed. The working in a temperature range of 600° C. or lower and the heat treatment of holding in a temperature range of 150 to 750° C. for 10 minutes to 72 hours may be performed for a plurality of times. After the final heat treatment, the working in a temperature range of 600° C. or lower may be performed.

The precipitates in the present invention mean, for example, $Cu_4Ti$, $Cu_9Zr_2$, $ZrCr_2$, metal Cr, metal Zr, metal Ag and the like, and the intermetallics mean, for example, Cr—Ti compound, Ti—Zr compound, Zr—Cr compound, metal oxides, metal carbides, metal nitrides and the like.

According to the present disclosure, a copper alloy containing no environmentally harmful element such as Be, which has wide product variations, and is excellent in high-temperature strength and workability, and also excellent in the performances required for safety tool materials, or thermal conductivity, wear resistance and spark generation resistance, and a method for producing the same can be provided.

DETAILED DESCRIPTION OF SPECIFIC EMBODIMENTS

Figure 1:
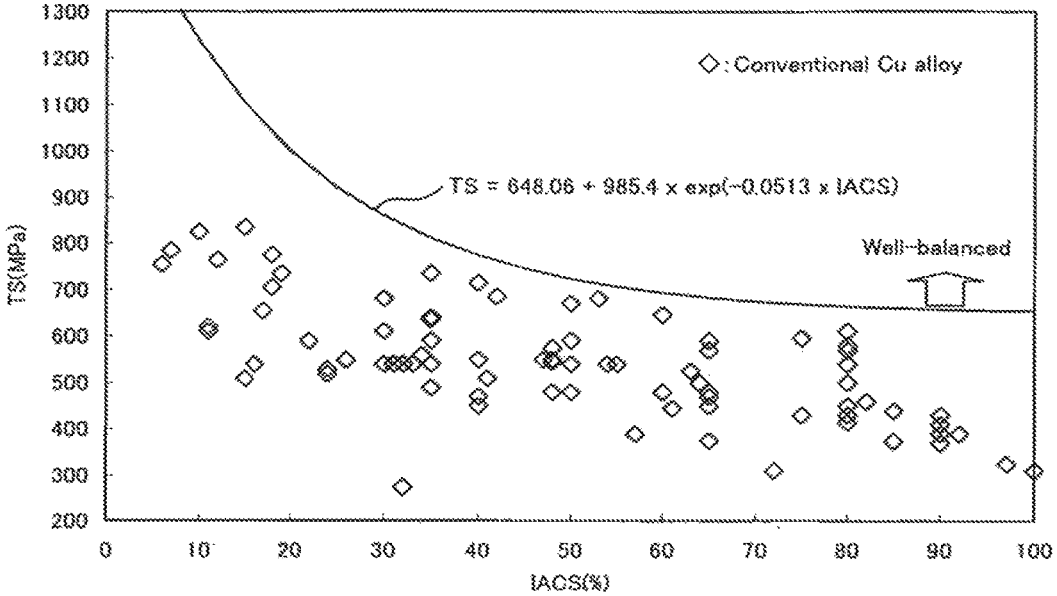
FIG. 1: A view showing the relationship between the tensile strength and electric conductivity of a copper alloy containing no harmful element such as Be described in Non-Patent Literature 1.
Figure 2:
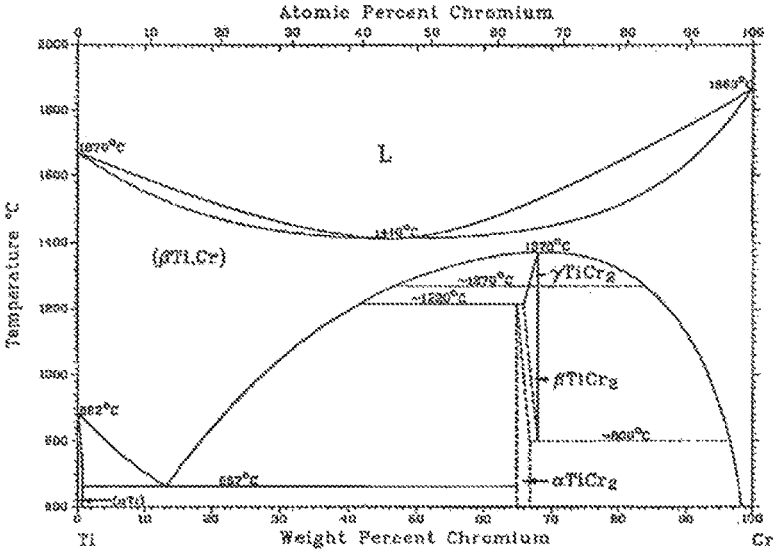
FIG. 2: A Ti—Cr binary system state view.
Figure 3:
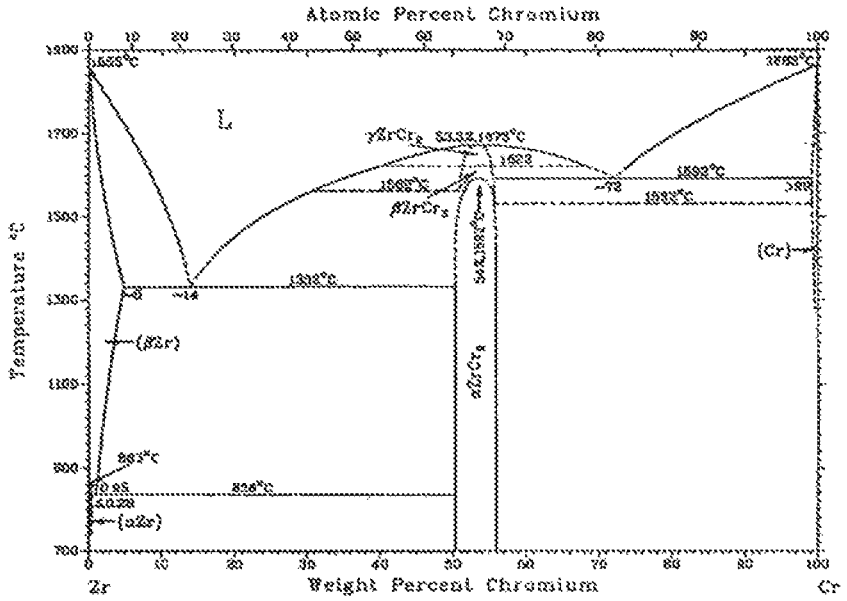
FIG. 3: A Zr—Cr binary system state view.
Figure 4:
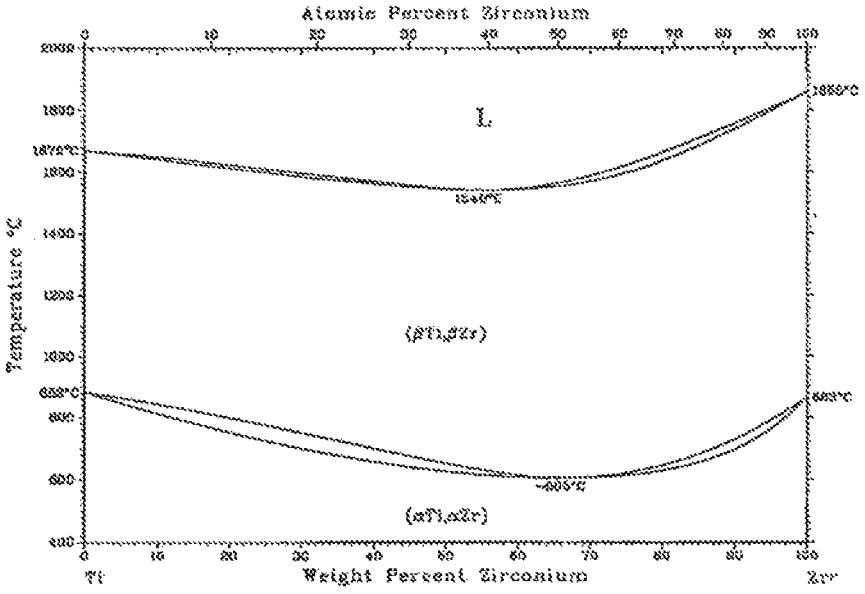
FIG. 4: A Ti—Zr binary system state view.

The alloys and methods disclosed herein will be described in more detail with respect to certain specific embodiments, which are not intended to limit the scope of the appended claims. In the following description, "%" for content of each element represents "% by mass" unless otherwise specified.

1. Copper Alloy of the Present Invention (A) Chemical Composition

One copper alloy described herein has a chemical composition consisting of at least two elements selected from Cr: 0.01 to 5%, Ti: 0.01 to 5% and Zr: 0.01 to 5%, and the balance Cu and impurities.

Cr: 0.01 to 5%

When the Cr content is below 0.01%, the alloy cannot have enough strength. Also, an alloy with well-balanced strength and electric conductivity cannot be obtained even if 0.01% or more Ti or Zr is included. Particularly, in order to obtain an extremely satisfactorily balanced state of tensile strength and electric conductivity equal to or more than that of a Be-added copper alloy, a content of 0.1% or more is desirable. On the other hand, if the Cr content exceeds 5%, coarse metal Cr is formed so as to adversely affect the bending characteristic, fatigue characteristic and the like. Therefore, the Cr content was regulated to 0.01 to 5%. The Cr content is desirably 0.1 to 4%, and most desirably 0.2 to 3%.

Ti: 0.01 to 5%

When the content of Ti is less than 0.01%, sufficient strength cannot be ensured even if 0.01% or more of Cr or Zr is included. However, if the content exceeds 5%, the electric conductivity deteriorates although the strength is enhanced. Further, segregation of Ti in casting makes it difficult to obtain a homogeneous dispersion of the precipitates, and cracking or chipping tends to occur in the subsequent working. Therefore, the Ti content was set to 0.01 to 5%. In order to obtain an extremely satisfactorily balanced state of tensile strength and electric conductivity, similarly to the case of Cr, a content of 0.1% or more is desirable. The Ti content is desirably 0.1 to 4%, and is most desirably 0.3 to 3%.

Zr: 0.01 to 5%

When the Zr content is less than 0.01%, sufficient strength cannot be obtained even if 0.01% or more of Cr or Ti is included. However, if the content exceeds 5%, the electric conductivity is deteriorated although the strength is enhanced. Further, segregation of Zr caused in casting makes it difficult to obtain a homogeneous dispersion of the precipitates, and cracking or chipping tends to occur in the subsequent working. In order to obtain an extremely satisfactorily balanced state of tensile strength and electric conductivity, similarly to the case of Cr, a content of 0.1% or more is desirable. The Zr content is desirably 0.1 to 4%, and most desirably 0.2 to 3%.

Another copper alloy described herein has the above-mentioned chemical components and further contains 0.01 to 5% of Ag instead of a part of Cu.

Ag is an element which hardly deteriorates electric conductivity even if it is dissolved in a Cu matrix. Metal Ag enhances the strength by fine precipitation. A simultaneous addition of two or more which are selected from Cr, Ti and Zr has an effect of more finely precipitating a precipitate such as $Cu_4Ti$, $Cu_9Zr_2$, $ZrCr_2$, metal Cr, metal Zr or metal Ag which contributes to precipitation hardening. This effect is noticeable at 0.01% or more, but a content exceeding 5%, leads to an increase in cost of the alloy. Therefore, the Ag content is desirably set to 0.01 to 5%, and further desirably to 2% or less.

The copper alloy described herein desirably contains, instead of a part of Cu, 5% or less in total of one or more elements selected from the following groups (b), (c) and (d) for the purpose of improving corrosion resistance and heat resistance.

group (b): 0.001 to 0.5% each of P, S, As, Pb and B group (c): 0.01 to 5% each of Sn, Mn, Fe, Co, Al, Si, Nb, Ta, Mo, V, W and Ge group (d): 0.01 to 3% each of Zn, Ni, Te, Cd and Se Each of these elements has an effect of improving corrosion resistance and heat resistance while keeping a balance between strength and electric conductivity. This effect is exhibited when 0.001% or more each of P, S, As, Pb and B, and 0.01% or more each of Sn, Mn, Fe, Co, Al, Si, Nb, Ta, Mo, V, W, Ge, Zn, Ni, Te, Cd, Se and Sr are included. However, when their contents are excessive, the electric conductivity is reduced. Accordingly, these elements are included at 0.001 to 0.5% in case of P, S, As, Pb and B, at 0.01 to 5% in case of Sn, Mn, Fe, Co, Al, Si, Nb, Ta, Mo, V, W and Ge, and at 0.01 to 3% in case of Zn, Ni, Te, Cd, and Se, respectively. Particularly, since Sn finely precipitates a Ti—Sn intermetallic compound in order to contribute to the increase in strength, its active use is preferred. It is desirable not to use As, Pd and Cd as much as possible since they are harmful elements.

If the total amount of these elements exceeds 5% in spite of the respective contents within the ranges, the electric conductivity is deteriorates. When one or more of the above elements are included, the total amount is needed to be limited within the range of 5% or less. The desirable range is 0.01 to 2%.

The copper alloy described herein desirably includes, instead of a part of Cu, 0.001 to 2% in total of one or more elements selected from the following group (e) for the purpose of increasing high-temperature strength.

group (e): Mg, Li, Ca and rare earth elements

Mg, Li, Ca and rare earth elements are easily bonded with an oxygen atom in the Cu matrix, leading to fine dispersion of the oxides which enhance the high-temperature strength. This effect is noticeable when the total content of these elements is 0.001% or more. However, a content exceeding 2% could result in saturation, and therefore causes problems such as reduction in electric conductivity and deterioration of bending workability. Therefore, when one or more element selected from Mg, Li, Ca and rare earth elements are included, the total content thereof is desirably set to 0.001 to 2%. The rare earth elements mean Sc, Y and lanthanide, may be added separately or in a form of misch metal.

The copper alloy disclosed herein desirably includes, 0.001 to 0.3% in total of one or more elements selected from the following group (f) for the purpose of extending the width (ΔT) between liquidus line and solidus line in the casting of the alloy, instead of a part of Cu. Although ΔT is increased by a so-called supercooling phenomenon in rapid solidification, ΔT in a thermally equilibrated state is considered herein as a standard.

group (f): Bi, Tl, Rb, Cs, Sr, Ba, Tc, Re, Os, Rh, In, Pd, Po, Sb, Hf, Au, Pt and Ga These elements in group (f) above, are effective for reducing the solidus line to extend ΔT. If this width ΔT is extended, casting is facilitated since a fixed time can be ensured up to solidification after casting. However, an excessively large ΔT causes reduction in proof stress in a low-temperature area, causing cracking at the end of solidification, or so-called solder embrittlement. Therefore, ΔT is preferably set within the range of 50 to 200° C.

C, N and O are generally included as impurities. These elements form carbides, nitrides and oxides with metal elements in the alloy. These elements may be actively added since the precipitates or intermetallics thereof are effective, if fine, for strengthening the alloy, particularly, for enhancing high-temperature strength similarly to the precipitates of $Cu_4Ti$, $Cu_9Zr_2$, $ZrCr_2$, metal Cr, metal Zr, metal Ag and the like which are described later. For example, O has an effect of forming oxides in order to enhance the high-temperature strength. This effect is easily obtained in an alloy containing elements which easily form oxides, such as Mg, Li, Ca and rare earth elements, Al, Si and the like. However, in this case, a condition in which the solid solution O never remains must be selected. Care should be taken with residual solid solution oxygen since it may cause, in heat treatment under hydrogen atmosphere, a so-called hydrogen disease of causing a phreatic explosion as $H_2O$ gas and generate blister or the like, which deteriorates the quality of the product.

When the content of each of these elements exceeds 1%, the precipitates or intermetallics thereof are coarse, deteriorating the ductility. Therefore, each content is preferably limited to 1% or less, and further preferably to 0.1% or less. As small as possible content of H is desirable, since H is left as on $H_2$ gas in the alloy, if included in the alloy as an impurity, causing rolling flaw or the like.

(B) The Total Number of Precipitates and Intermetallics

In the copper alloy disclosed herein, the relationship between the total number N and the diameter X satisfies the following formula (1):

$$\log N \leq 0.4742 + 17.629 \times \exp(-0.1133 \times X) \quad (1)$$

wherein N means the total number of precipitates and intermetallics, having a diameter of not smaller than 1 μm which are found in 1 $mm^2$ of the alloy; and X means the diameter in μm of the precipitates and the intermetallics having diameter of not smaller than 1 μm. In the formula (1), X=1 is substituted when the measured value of the grain size of the precipitates and the intermetallics are 1.0 μm or more and less than 1.5 μm, and X=α (α is an integer of 2 or more) and can be substituted when the measured value is (α−0.5) μm or more and less than (α+0.5) μm.

In the copper alloy disclosed herein, $Cu_4Ti$, $Cu_9Zr_2$, $ZrCr_2$, metal Cr, metal Zr or metal Ag are finely precipitated, whereby the strength can be improved without reducing the electric conductivity. They enhance the strength by precipitation hardening. The dissolved Cr, Ti, and Zr are reduced by precipitation, and the electric conductivity of the Cu matrix comes close to that of pure Cu.

However, when $Cu_4Ti$, $Cu_9Zr_2$, $ZrCr_2$, metal Cr, metal Zr, metal Ag, Cr—Ti compound, Ti—Zr compound or Zr—Cr compound is coarsely precipitated with a grain size of 20 μm or more, the ductility deteriorates, easily causing cracking or chipping, for example, at the time of bending work or punching when working with a connector. It might adversely affect fatigue characteristic and impact resistance characteristic in use. Particularly, when a coarse Ti—Cr compound is formed at the time of cooling after solidification, cracking or chipping tends to occur in the subsequent working process. Since the hardness is excessively increased in an aging treatment process, fine precipitation of $Cu_4Ti$, $Cu_9Zr_2$, $ZrCr_2$, metal Cr, metal Zr or metal Ag is inhibited, so that the copper alloy cannot be strengthened. Such a problem is noticeable when the relationship between the total number of N and the diameter X do not satisfy the above formula (1).

In the present disclosure, therefore, an essential requirement is regulated so that the relationship between the total number of N and the diameter X satisfies the above formula (1). The total number of the precipitates and the intermetallics desirably satisfies the following formula (2), and further preferably satisfies the following formula (3). The grain size and the total number of the precipitates and the intermetallics can be determined by using a method shown in examples.

$$\log N \leq 0.4742+7.9749\times\exp(-0.1133\times X) \quad (2)$$

$$\log N \leq 0.4742+6.3579\times\exp(-0.1133\times X) \quad (3)$$

wherein N means the total number of precipitates and intermetallics, having a diameter not smaller than 1 μm which are found in 1 $mm^2$ of the alloy; and X means the diameter in μm of the precipitates and the intermetallics having diameter not smaller than 1 μm.

(C) Ratio of the Average Content Maximum Value to the Average Content Minimum Value in Micro-Area of at Least One Alloy Element The presence of a texture having areas with different concentrations of alloy elements finely included in the copper alloy, or the occurrence of a periodic concentration change has an effect of facilitating acquisition of the micro-crystal grain structure, since it inhibits fine diffusion of each element, which inhibits the grain boundary migration. Consequently, the strength and ductility of the copper alloy are improved according to the so-called Hall-Petch law. The micro-area means an area consisting of 0.1 to 1 μm diameter, which substantially corresponds to an irradiation area in X-ray analysis.

The areas with different alloy element concentrations in the present disclosure are the following two types.

(1) A state basically having the same fcc structure as Cu, but having different alloy element concentrations. The lattice constant is generally differed in spite of the same fcc structure due to the different alloy element concentrations, and also the degree of work hardening is of course differed.

(2) A state where fine precipitates are dispersed in the fcc base phase. The dispersed state of precipitates after working and heat treatment is of course differed due to the different alloy element concentrations.

The average content in the micro-area means the value in an analysis area when narrowing to a fixed beam diameter of 1 μm or less in the X-ray analysis, or an average in this area. In case of the X-ray analysis, an analyzer having a field emission type electron gun is desirably used. Analyzing desirable means includes a resolution of ⅕ or less of the concentration period, and 1/10 is further desirable. This is true if the analysis area is too large during the concentration period, the whole is averaged to make the concentration difference difficult to emerge. Generally, the measurement can be performed by an X-ray analysis method with a probe diameter of about 1 μm.

It is the alloy element concentration and fine precipitates in the base phase that determines the material characteristics, and the concentration difference in micro-area including fine precipitates is questioned in the present invention. Accordingly, signals from coarse precipitates or coarse intermetallics of 1 μm or more are disturbance factors. However, it is difficult to perfectly remove the coarse precipitates or coarse intermetallics from an industrial material, and therefore it is necessary to remove these disturbing factors from the coarse precipitates and intermetallics at the time of analysis. The following procedure is therefore taken.

A line analysis is performed using of an X-ray analyzer with a probe diameter of about 1 μm in order to grasp the periodic structure of concentration, although it is varied depending on the materials. An analysis method is determined so that the probe diameter is about ⅕ of the concentration period or less as described above. A sufficient line analysis length, where the period emerges about three times or more is determined. The line analysis is performed m-times (desirably 10 times or more) under this condition, and the maximum value and the minimum value of concentration are determined for each of the line analysis results. M pieces each of the resulting maximum values and minimum values are cut by 20% from the larger value side and averaged. By the above-mentioned procedure, the disturbing factors can be removed by the signals from the coarse precipitates and intermetallics.

The concentration ratio is determined by the ratio of the maximum value compared to the minimum value from which the disturbance factors have been removed. The concentration ratio can be determined for an alloy element, having a periodic concentration change of about 1 μm or more, without taking a concentration change of an atomic level of about 10 nm or less, such as spinodal decomposition or micro-precipitates, into consideration.

The reason that the ductility is improved by finely distributing alloy elements will now be described in detail. When a concentration change of an alloy element takes place, the mechanical properties between the high-concentration part and the low-concentration part, differ the degree of solid-solution hardening of materials or the dispersed state of precipitates between them. During such deformation of the material, the relatively soft low-concentration part is work-hardened first, and then the deformation of the relatively hard high-concentration part is started. In other words, since the work hardening is caused for a plurality of times as the whole material, high elongation is shown, for example, in tensile deformation, and also ductility improvement is seen. Thus, in an alloy where a periodic concentration change of alloy elements takes place, high ductility advantages for bending work or the like can be exhibited while keeping the balance between electric conductivity and tensile strength.

Since the electric resistance (the inverse of electric conductivity) mainly responds to a phenomenon in which the electron transition is reduced due to the scattering of dissolved elements, and is hardly affected by a macro defect such as grain boundary, the electric conductivity is never reduced by the fine grain structure.

This effect is noticeable when the ratio of an average content maximum value to an average content minimum value in the micro-area of at least one alloy element in the base phase (hereinafter simply referred to as "concentration ratio") is 1.5 or more. The upper limit of the concentration ratio is not particularly determined. However, an excessively high concentration ratio might cause adverse effects, such that an excessively increased difference of the electrochemical characteristics which facilitates local corrosion, and in addition to that the fcc structure possessed by the Cu alloy cannot be kept. Therefore, the concentration ratio is set preferably to 20 or less, and more preferably to 10 or less.

(D) Grain Size

A finer grain size of the copper alloy is advantageous for enhancing the strength, and also leads to an improvement in ductility which improves bending workability and the like. However, when the grain size is below 0.01 μm, high-temperature strength may be reduced, and if it exceeds 35 μm, the ductility is reduced. Therefore, the grain size is desirably set at 0.01 to 35 μm, and further desirably to 0.05 to 30 μm, and most desirably to 0.1 to 25 μm.

2. Method for Producing a Copper Alloy of the Present Invention

In the copper alloy disclosed herein, intermetallics such as Cr—Ti compound, Ti—Zr compound, and Zr—Cr compound, which inhibit the fine precipitation of $Cu_4Ti$, $Cu_9Zr_2$, $ZrCr_2$, metal Cr, metal Zr or metal Ag and tend to formed just after the solidification from the melt. It is difficult to dissolve such intermetallics even if the solution treatment is performed after casting, even if the solution treatment temperature is raised. The solution treatment at a high temperature only causes coagulation and the coarsening of the intermetallics.

Therefore, in the method for producing the copper alloy disclosed herein, a bloom, a slab, a billet, or a ingot, obtained by melting the copper alloy having the above chemical composition by casting, is cooled to at least a temperature range from the bloom, the slab, the billet, or the ingot temperature just after casting to 450° C., at a cooling rate of 0.5° C./s or more, whereby the relationship between the total number N and the diameter X satisfies the following formula (1):

$$\log N \leq 0.4742 + 17.629 \times \exp(-0.1133 \times X) \quad (1)$$

wherein N means the total number of precipitates and intermetallics, having a diameter of not smaller than 1 μm which are found in 1 $mm^2$ of the alloy; and X means the diameter in μm of the precipitates and the intermetallics having diameter of not smaller than 1 μm.

After the cooling, working in a temperature range of 600° C. or lower, and a holding heat treatment for 30 seconds or more in a temperature range of 150 to 750° C. after this working are desirably performed. The working in a temperature range of 600° C. or lower and the holding heat treatment for 30 seconds or more in a temperature range of 150 to 750° C. are further desirably performed for a plurality of times. After the final heat treatment, the working may be further performed.

(A) a cooling Rate at Least in a Temperature Range from the Bloom, the Slab, the Billet, or the Ingot Temperature Just after Casting to 450° C.: 0.5° C./s or More The intermetallics such as Cr—Ti compound, Ti—Zr compound or Zr—Cr compound, and precipitates such as $Cu_4Ti$, $Cu_9Zr_2$, $ZrCr_2$, metal Cr, metal Zr or metal Ag are formed in a temperature range of 280° C. or higher. Particularly, when the cooling rate in a temperature range, from the bloom, the slab, the billet, or the ingot temperature just after casting to 450° C. is low and the intermetallics, such as Cr—Ti compound, Ti—Zr compound or Zr—Cr compound are coarsely formed, and the grain size thereof may reach 20 μm or more, and further hundreds μm. The $Cu_4Ti$, $Cu_9Zr_2$, $ZrCr_2$, metal Cr, metal Zr or metal Ag is also coarsened to 20 μm or more. In a state where such coarse precipitates and intermetallics are formed, not only cracking or chipping may take place in the subsequent working, but also a precipitation hardening effect of the $Cu_4Ti$, $Cu_9Zr_2$, $ZrCr_2$, metal Cr, metal Zr or metal Ag in an aging process is impaired, so that the alloy cannot be strengthened. Accordingly, it is needed to cool the bloom, the slab, the billet, or the ingot at a cooling rate of 0.5° C./s or more at least in this temperature range. A higher cooling rate is more preferable. The cooling rate is preferably 2° C./s or more, and more preferably 10° C./s or more.

(B) Working Temperature after Cooling: A Temperature Range of 600° C. or Lower

In the method for producing a copper alloy of the present invention, the bloom, the slab, the billet, or the ingot obtained by casting is made into a final product, after cooling under a predetermined condition, only by a combination of working and aging heat treatment without passing through a hot process, such as hot rolling or solution treatment.

A working such as rolling or drawing may be performed at 600° C. or lower. For example, when continuous casting is adapted, such a working can be performed in the cooling process after solidification. When the working is performed in a temperature range exceeding 600° C., $Cu_4Ti$, $Cu_9Zr_2$, $ZrCr_2$, metal Cr, metal Zr or metal Ag is coarsely formed at the time of working, deteriorating the ductility, impact resistance, and fatigue property of the final product. When the above-mentioned precipitates are coarsened at the time of working, $Cu_4Ti$, $Cu_9Zr_2$, $ZrCr_2$, metal Cr, metal Zr or metal Ag cannot be finely precipitated in the aging treatment, resulting in an insufficient strengthening of the copper alloy.

Since the dislocation density in working is raised more as the working temperature is lower, $Cu_4Ti$, $Cu_9Zr_2$, $ZrCr_2$, metal Cr, metal Zr or metal Ag can be more finely precipitated in the subsequent aging treatment. Therefore, further high strength can be given to the copper alloy. The working temperature is preferably 450° C. or lower, more preferably 250° C. or lower, and most preferably 200° C. or lower. The temperature may also be 25° C. or lower.

The working in the above temperature range is desirably performed at a working rate (section reduction rate) of 20% or more, and more desirably 50% or more. If the working is performed at such a working rate, the dislocation introduced thereby can act as precipitation nuclei at the time of aging treatment, which leads to fine dispersion of the precipitates and also shortens of the time required for the precipitation, and therefore the reduction of dissolved elements harmful to electric conductivity can be early realized.

(C) Aging Treatment Condition: Holding for 30 Seconds or More in a Temperature Range of 150 to 750° C.

The aging treatment is effective for precipitating $Cu_4Ti$, $Cu_9Zr_2$, $ZrCr_2$, metal Cr, metal Zr or metal Ag in order to strengthen the copper alloy, and also reduce dissolved elements (Cr, Ti, etc.) harmful to electric conductivity in order to improve the electric conductivity. However, at a treatment temperature below 150° C., an excessive amount of time is required for the diffusion of the precipitated elements, which reduces the productivity. On the other hand, at a treatment temperature exceeding 750° C., not only the precipitates are too coarsened to attain the strengthening by the precipitation hardening effect, but also the ductility, impact resistance and fatigue characteristic deteriorates. Therefore, the aging treatment is desirably performed in a temperature range of 150 to 750° C. The aging treatment temperature is desirably 200 to 750° C., further desirably 250 to 650° C., and most desirably 280 to 550° C.

When the aging treatment time is less than 30 seconds, a desired precipitation quantity cannot be ensured even if the aging treatment temperature is high. Therefore, the aging treatment in a temperature range of 150 to 750° C. is desirably performed for 30 seconds or more. The treatment time is desirably 5 minutes or more, further desirably 10 minutes or more, and most desirably 15 minutes or more. The upper limit of the treatment time is not particularly limited. However, 72 hours or less is desirable from the point of the treatment cost. When the aging treatment temperature is high, the aging processing time can be shortened.

The aging treatment is preferably performed in a reductive atmosphere, in an inert gas atmosphere, or in a vacuum of 20 Pa or less in order to prevent the generation of scales due to oxidation on the surface. Excellent plating property can also be ensured by the treatment in such an atmosphere.

The above-mentioned working and aging treatment may be performed repeatedly as the occasion demands. When the working and aging treatment are repeatedly performed, a desired precipitation quantity can be obtained in a shorter time than in the case of one set treatment (working and aging treatment), and $Cu_4Ti$, $Cu_9Zr_2$, $ZrCr_2$, metal Cr, metal Zr or metal Ag can be more finely precipitated. For example, when the treatment is repeated twice, the second aging treatment temperature is preferably set slightly lower than the first aging treatment temperature (by 20 to 70° C.). If the second aging treatment temperature is higher, the precipitates formed in the first aging treatment are coarsened. On and after the third aging treatment, the temperature is desirably set lower than the previous aging treatment temperature.

(D) Others

In the method for producing the copper alloy disclosed herein, conditions other than the above production condition, for example, conditions for melting, casting and the like are not particularly limited. These treatments may be performed as follows.

Melting is preferably performed in a non-oxidative or reductive atmosphere. If the dissolved oxygen in a molten copper is increased, the so-called hydrogen disease of generating blister by generation of steam is caused in the subsequent process. Further, coarse oxides of easily-oxidizable dissolved elements, for example, Ti, Cr and the like, are formed, and if they are left in the final product, the ductility and fatigue characteristic are seriously reduced.

In order to obtain the bloom, the slab, the billet, or the ingot, continuous casting is preferably adapted from the point of productivity and solidification rate. However, any other methods which satisfy the above-mentioned conditions, for example, an ingot method, can be used. The casting temperature is preferably 1250° C. or higher, and further preferably 1350° C. or higher. At this temperature, two or more of Cr, Ti and Zr can be sufficiently dissolved, and formation of intermetallics such as Cr—Ti compound, Ti—Zr compound and Zr—Cr compound, and precipitates such as $Cu_4Ti$, $Cu_9Zr_2$, $ZrCr_2$, metal Cr, metal Zr or metal Ag can be prevented.

When the bloom, the slab, or the billet is obtained by the continuous casting, a method using graphite mold which is generally adapted for a copper alloy is recommended from the viewpoint of lubricating property. As a mold material, a refractory material which is hardly reactive with Ti, Cr or Zr that is an essential alloy element, for example, zirconia may be used.

Example 1

Copper alloys, having chemical compositions shown in Tables 1 to 4 were melted by a vacuum induction furnace, and cast in a zirconia-made mold, whereby slabs 12 mm thick were obtained. Each of rare earth elements was added alone or in a form of misch metal.

TABLE 1

| Alloy | Chemical Composition (mass %, Balance: Cu & Impurities) | | | |
|---|---|---|---|---|
| No. | Cr | Ti | Zr | Ag |
| 1 | 5.60* | 0.02 | — | 6.01* |
| 2 | 4.50* | 6.01* | 0.05 | — |
| 3 | 5.40* | 0.08 | 5.20* | — |
| 4 | 4.62* | — | 5.99* | — |
| 5 | 0.11 | 0.10 | 5.00 | — |
| 6 | 0.12 | 1.01 | — | 5.00 |
| 7 | 0.18 | 2.98 | — | — |
| 8 | 0.10 | 4.98 | — | — |
| 9 | 0.98 | 0.15 | — | — |
| 10 | 1.05 | 1.02 | 0.40 | 0.20 |
| 11 | 1.02 | 2.99 | 0.10 | — |
| 12 | 1.99 | 0.09 | — | — |
| 13 | 1.99 | 1.01 | — | — |
| 14 | 2.99 | 0.12 | — | 0.10 |
| 15 | 3.00 | 1.00 | — | — |
| 16 | 2.98 | 3.01 | — | — |
| 17 | 2.99 | 4.98 | — | — |
| 18 | — | 0.10 | 0.11 | 3.40 |
| 19 | — | 0.99 | 0.12 | — |
| 20 | — | 2.99 | 0.18 | — |
| 21 | — | 4.99 | 0.10 | — |
| 22 | — | 0.11 | 1.01 | — |
| 23 | 0.50 | 1.02 | 0.99 | — |
| 24 | — | 2.52 | 1.52 | — |
| 25 | — | 5.00 | 0.99 | 0.25 |
| 26 | — | 0.12 | 2.00 | — |
| 27 | — | 0.98 | 1.97 | — |
| 28 | — | 3.01 | 2.01 | — |
| 29 | — | 4.99 | 1.99 | — |
| 30 | — | 0.10 | 3.01 | — |
| 31 | — | 1.01 | 3.01 | — |
| 32 | — | 3.00 | 2.99 | — |
| 33 | 0.10 | 4.99 | 2.98 | — |
| 34 | 0.11 | 5.00 | 0.10 | 2.10 |
| 35 | 0.12 | — | 0.99 | — |
| 36 | 0.18 | — | 2.99 | — |
| 37 | 0.10 | — | 4.99 | — |
| 38 | 1.01 | 2.00 | 0.11 | — |
| 39 | 0.99 | — | 1.02 | — |
| 40 | 1.01 | — | 2.99 | 0.25 |
| 41 | 0.99 | — | 5.00 | — |
| 42 | 2.00 | — | 0.12 | — |
| 43 | 1.97 | — | 0.98 | — |
| 44 | 2.01 | — | 3.01 | — |

TABLE 1-continued

| Alloy No. | Chemical Composition (mass %, Balance: Cu & Impurities) Cr | Ti | Zr | Ag |
|---|---|---|---|---|
| 45 | 1.99 | — | 4.99 | 0.10 |
| 46 | 3.01 | — | 0.10 | 1.00 |
| 47 | 3.01 | — | 1.01 | — |
| 48 | 2.99 | — | 3.00 | — |
| 49 | 2.98 | — | 4.99 | — |
| 50 | 2.50 | 0.01 | — | — |
| 51 | 0.08 | 0.02 | — | |
| 52 | 0.99 | 1.50 | — | 0.04 |
| 53 | 0.01 | 0.07 | — | 5.00 |

TABLE 1-continued

| Alloy No. | Chemical Composition (mass %, Balance: Cu & Impurities) Cr | Ti | Zr | Ag |
|---|---|---|---|---|
| 54 | — | 0.01 | 0.02 | — |
| 55 | — | 0.03 | 0.05 | 0.02 |
| 56 | — | 0.05 | 0.01 | — |
| 57 | 0.02 | — | 1.99 | 0.01 |
| 58 | 0.98 | 1.50 | 0.01 | — |
| 59 | 1.02 | 2.00 | 0.06 | — |
| 60 | 0.02 | — | 2.00 | — |

*Out of the range regulated by the present invention.

TABLE 2

| Alloy No. | Chemical Composition (mass %, Balance: Cu & Impurities) Cr | Ti | Zr | Ag | group (b) element | group (c) element | group (d) element | Total of group (b) to (d) | group (e) element | Total of group (e) | group (f) element | Total of group (f) |
|---|---|---|---|---|---|---|---|---|---|---|---|---|
| 61 | 1.03 | 1.56 | — | — | P: 0.001 | | | 0.001 | Li: 0.01 | 0.010 | | |
| 62 | 0.97 | 2.00 | — | 0.22 | | Si: 2.10, W: 1.20 | Ni: 1.20 | 4.50 | | — | | |
| 63 | 0.98 | 1.99 | — | — | | Sn: 5.00 | | 5.00 | | — | | |
| 64 | 1.01 | 2.05 | — | — | | | | 0.00 | | — | Sb: 0.3 | 0.300 |
| 65 | 0.99 | 1.99 | 0.10 | — | | Fe: 5.00 | | 5.00 | | — | | |
| 66 | 1.01 | 2.02 | 0.49 | — | | Sn: 1.49, Fe: 0.49, Ta: 0.01 | Ni: 0.01, Se: 3.00 | 5.00 | | — | | |
| 67 | 1.02 | 2.01 | 0.72 | — | | Sn: 0.31 | Zn: 0.01 | 0.32 | | — | Bi: 0.001, Hf: 0.01 | 0.011 |
| 68 | 0.99 | 1.98 | — | — | | | | 0.00 | | — | Hf: 0.05 | 0.050 |
| 69 | 1.03 | 1.93 | — | — | P: 0.010 | Sn: 0.99, Fe: 0.01, Si: 0.01 | | 1.02 | | — | | |
| 70 | 1.01 | 1.95 | — | — | | Al: 5.00 | | 5.00 | | — | | |
| 71 | 1.01 | 2.00 | — | — | | Sn: 0.42, Mn: 0.01, Co: 0.01, Al: 0.20 | | 0.64 | | — | Sr: 0.01 | 0.010 |
| 72 | 1.02 | 1.98 | — | — | | Sn: 0.21, Si: 0.49, W: 2.80 | | 3.50 | | — | | |
| 73 | 0.98 | 2.01 | — | 0.10 | B: 0.010 | | Zn: 0.21 | 0.22 | | — | | |
| 74 | 1.02 | 1.98 | 0.35 | — | | Sn: 0.58 | | 0.58 | Y: 0.5, La: 1.2 | 1.7 | | |
| 75 | 0.99 | 1.99 | 0.52 | — | | | Ni: 0.79 | 0.79 | | — | | |
| 76 | 1.01 | 1.98 | — | — | P: 0.100 | Mn: 0.01, Al: 0.01, V: 2.50 | | 2.62 | | — | | |
| 77 | 0.99 | 1.98 | — | — | | Al: 0.35, Mo: 2.46, Ge: 0.45 | | 3.26 | | — | In: 0.05, Te: 0.001 | 0.051 |
| 78 | 0.98 | 2.02 | — | 5.00 | | Si: 2.00 | | 2.00 | | — | | |
| 79 | 0.98 | 1.79 | — | — | | Nb: 0.02, Mo: 0.02 | | 0.04 | Mg: 0.001 | 0.001 | | |
| 80 | 1.02 | 2.02 | — | — | | Fe: 0.01, Co: 1.00 | Ni: 0.12 | 1.13 | | — | Hf: 0.20 | 0.200 |
| 81 | 1.03 | 1.99 | — | — | | Sn: 0.01, Co: 0.49, Ta: 0.30 | | 0.80 | | — | | |
| 82 | 0.99 | 2.01 | 3.00 | — | B: 0.500 | Fe: 0.10 | Te: 3.00 | 3.60 | | — | | |
| 83 | 1.00 | 1.99 | — | — | | | Zn: 3.00 | 3.00 | | — | Sb: 0.001 | 0.001 |
| 84 | 0.98 | 2.00 | — | — | | | Ni: 3.00 | 3.00 | | — | | |
| 85 | 1.02 | 2.01 | 1.01 | — | | Si: 5.00 | | 5.00 | | — | | |
| 86 | — | 1.99 | 1.00 | — | | Nb: 5.00 | | 5.00 | | — | | |
| 87 | 0.99 | 1.50 | — | — | | Sn: 0.41 | | 0.41 | | — | | |
| 88 | — | 1.99 | 0.99 | — | | | Zn: 0.25 | 0.26 | | — | | |
| 89 | — | 1.99 | 0.99 | — | P: 0.001 | Al: 0.31 | | 0.311 | | — | | |
| 90 | 0.08 | 1.95 | 1.08 | — | | Sn: 1.43, Al: 0.65 | | 2.08 | Mg: 0.1, Nd: 0.2, Y: 0.05 | 0.35 | | |

TABLE 3

| Alloy No. | Chemical Composition (mass %, Balance: Cu & Impurities) Cr | Ti | Zr | Ag | group (b) element | group (c) element | group (d) element | Total of group (b) to (d) | group (e) element | Total of group (e) | group (f) element | Total of group (f) |
|---|---|---|---|---|---|---|---|---|---|---|---|---|
| 91 | 0.49 | 2.01 | 1.00 | — | | V: 0.01 | Ni: 0.01, Te: 0.01 | 0.03 | | — | | |
| 92 | 0.73 | 2.01 | 1.00 | — | | Sn: 0.31, Fe: 0.31, Si: 0.39 | Zn: 0.01 | 1.02 | | — | | |
| 93 | — | 2.01 | 0.99 | — | | Sn: 0.45 | | 0.45 | | — | In: 0.24 | 0.240 |
| 94 | — | 1.99 | 0.98 | — | | Sn: 1.00, Si: 0.01 | | 1.01 | | — | | |
| 95 | — | 2.00 | 0.97 | — | | Al: 2.00, W: 0.01 | | 2.01 | | — | | |
| 96 | — | 2.00 | 0.99 | — | | Co: 0.01, Ge: 3.10 | | 3.11 | | — | | |
| 97 | — | 2.00 | 0.99 | — | | Sn: 0.20, Co: 0.40, Si: 0.47 | | 1.07 | | — | | |
| 98 | — | 1.98 | 1.00 | — | B: 0.100 | | Te: 1.46 | 1.56 | | — | | |

TABLE 3-continued

| Alloy No. | Chemical Composition (mass %, Balance: Cu & Impurities) | | | | | | | | | | | |
|---|---|---|---|---|---|---|---|---|---|---|---|---|
| | Cr | Ti | Zr | Ag | group (b) element | group (c) element | group (d) element | Total of group (b) to (d) | group (e) element | Total of group (e) | group (f) element | Total of group (f) |
| 99 | 0.29 | 1.99 | 1.01 | — | | Co: 2.00 | | 2.00 | | — | | |
| 100 | 0.45 | 1.99 | 1.01 | — | | Si: 0.40 | Se: 1.52 | 1.92 | | — | | |
| 101 | — | 1.99 | 1.01 | — | | Mn: 0.01, Si: 0.05 | | 0.06 | | — | Sb: 0.010, In: 0.01 | 0.020 |
| 102 | — | 2.01 | 0.99 | — | | Mn: 0.53, Si: 2.00 | | 2.53 | | — | | |
| 103 | — | 2.01 | 0.99 | — | | Mn: 5.00 | | 5.00 | | — | | |
| 104 | — | 2.01 | 1.00 | — | B: 0.001 | W: 2.30 | | 2.30 | | — | | |
| 105 | — | 1.98 | 1.00 | — | | Sn: 0.01 | | 0.01 | | — | | |
| 106 | 3.00 | 1.98 | 1.00 | — | | Ge: 3.01 | | 3.01 | | — | | |
| 107 | — | 1.98 | 1.00 | — | | Ta: 5.00 | | 5.00 | | — | | |
| 108 | — | 2.00 | 0.99 | 0.25 | | Si: 2.00, V: 1.00 | Zn: 0.50 | 3.50 | | — | | |
| 109 | 1.02 | 2.00 | 1.01 | — | | Fe: 0.10, Al: 1.00, Si: 1.00 | Se: 0.01 | 2.11 | | — | | |
| 110 | 1.00 | — | 1.99 | — | | Mo: 5.00 | | 5.00 | | — | | |
| 111 | 0.98 | — | 2.01 | — | | | Zn: 3.00 | 3.00 | | — | Sb: 0.1, Hf: 0.01 | 0.110 |
| 112 | 0.99 | — | 1.99 | — | | Al: 3.52, Si: 0.04 | | 3.56 | | — | | |
| 113 | 0.99 | 1.00 | 2.01 | — | | Fe: 3.20 | Ni: 1.00 | 4.20 | | — | | |
| 114 | 1.00 | 0.51 | 2.00 | 0.25 | | Sn: 1.50 | Ni: 1.00 | 2.50 | | — | | |
| 115 | 1.01 | 0.75 | 2.01 | — | | W: 5.00 | | 5.00 | | — | | |
| 116 | 1.02 | — | 1.98 | — | | Sn: 0.2, V: 0.5 | | 0.70 | Mm: 0.25 | 0.25 | | |
| 117 | 1.08 | — | 2.03 | — | | Sn: 0.4, Nb: 2.01 | | 2.41 | Se: 0.3, Gd: 0.2 | 0.5 | | |
| 118 | 0.99 | — | 1.99 | — | | | Te: 0.45 | 0.45 | | | In: 0.1, Bi: 0.12 | 0.220 |
| 119 | 0.98 | — | 2.01 | — | | Sn: 0.41, Mn: 0.01, Al: 0.19 | | 0.61 | | — | | |
| 120 | 1.01 | — | 2.01 | — | | Sn: 0.19, Si: 0.48 | Zn: 0.01 | 0.68 | | — | | |

Ms: Misch metal

TABLE 4

| Alloy No. | Chemical Composition (mass %, Balance: Cu & Impurities) | | | | | | | | | | | |
|---|---|---|---|---|---|---|---|---|---|---|---|---|
| | Cr | Ti | Zr | Ag | group (b) element | group (c) element | group (d) element | Total of group (b) to (d) | group (e) element | Total of group (e) | group (f) element | Total of group (f) |
| 121 | 1.02 | — | 1.98 | — | B: 0.020 | Ta: 2.20 | | 2.22 | | — | | |
| 122 | 1.01 | 0.31 | 2.01 | — | | Co: 5.00 | | 5.00 | | — | | |
| 123 | 1.00 | 0.49 | 1.98 | — | | Si: 0.39 | | 0.39 | | — | | |
| 124 | 1.00 | — | 2.02 | — | P: 0.500 | | | 0.50 | Nd: 0.3, Ce: 0.1 | 0.4 | | |
| 125 | 0.99 | — | 2.01 | 0.25 | B: 0.100 | Si: 1.00, Ta: 0.99 | Se: 1.00 | 3.09 | | — | | |
| 126 | 0.97 | — | 2.01 | — | | Mn: 0.52, Si: 2.00 | | 2.52 | | — | | |
| 127 | 1.02 | — | 1.99 | — | | Si: 1.00, Nb: 0.50, V: 0.50, W: 0.50 | | 2.50 | | — | | |
| 128 | 1.00 | — | 2.02 | — | | Al: 0.11, Si: 0.20 | | 0.31 | | — | Sb: 0.005, Sr: 0.03 | 0.085 |
| 129 | 1.01 | — | 1.98 | — | | Sn: 2.41, Al: 0.19, Si: 0.2 | | 2.80 | Mm: 0.3, Li: 0.05 | 0.35 | | |
| 130 | 0.98 | 3.00 | 2.00 | — | | Ge: 5.00 | | 5.00 | | — | | |
| 131 | 1.01 | — | 1.98 | — | P: 0.100, B: 0.100 | | Zn: 3.00 | 3.20 | | — | | |
| 132 | 0.97 | — | 2.01 | 8.00 | | Nb: 0.01 | Ni: 8.00 | 3.01 | | — | | |
| 133 | 0.99 | 0.98 | 2.00 | — | | Fe: 0.15, Sn: 0.08 | | 0.23 | | — | Hf: 0.13 | 0.18 |
| 134 | 4.10 | — | 5.20* | | B: 0.050 | Si: 2.40 | Te: 1.00 | 3.45 | Ca: 1.0, Li: 1.0, Mg1.0 | 3.0* | | |
| 135 | 4.50 | 5.6* | — | | | W: 1.50, Mo: 2.1 | Ce: 2.40, Se: 3.10* | 9.1* | | — | | |
| 136 | 5.22* | 1.25 | 5.32* | | | V: 0.5, Fe: 2.6 | Ni: 2.8 | 5.9* | | — | Bi: 3.5* | 3.5* |
| 137 | 4.52 | 0.05 | — | | | Si: 2.01, V: 0.01 | | 2.02 | Sc: 1.6, La: 1.8 | 3.4* | Bi: 0.020 | 0.020 |
| 138 | 4.99 | 0.05 | — | 6.00* | | Sn: 1.20, Co: 0.20, Nb: 1.10, Ge: 0.10 | | 2.60 | Y: 3.4 | 3.4* | Sr: 0.01 | 0.01 |
| 139 | 4.20 | 2.01 | 5.48* | | P: 0.050 | Al: 0.01 | Se: 2.40 | 2.46 | Ca: 1.2, Ce: 2.8 | 3.0* | In: 1.4 | 1.4* |
| 140 | — | 5.51* | 5.01* | | P: 0.100 | Sn: 0.50, Ta: 2.40, V: 1.23 | Te: 0.42 | 4.65 | | — | Sr: 0.98 | 0.98* |
| 141 | 0.01 | 2.02 | — | | | | | | Mg: 0.01, Ca: 0.001 | 0.011 | Ga: 0.2, Rb: 0.08 | 0.28 |
| 142 | 1.00 | 1.51 | — | | | Sn: 0.4 | | 0.40 | | | Au: 0.01 | 0.01 |
| 143 | 0.04 | 1.02 | — | | P: 0.001 | Co: 0.05, Sn: 0.32 | | 0.37 | La: 0.01, Nd: 0.011 | 0.021 | Tl: 0.04, Po: 0.02 | 0.06 |
| 144 | 4.01 | 1.82 | — | 0.01 | | | Zn: 0.01 | 0.01 | Ca: 0.1, Gd: 0.003 | 0.103 | Pd: 0.1, Os: 0.03 | 0.13 |
| 145 | 1.02 | 1.59 | — | | | Mn: 0.5, Nb: 0.21, Ta: 0.01 | Ni: 0.05, Te: 0.04 | 0.81 | | | Re: 0.05, Tc: 0.01 | 0.06 |
| 146 | 2.02 | 2.01 | 0.01 | | | Sn: 0.45 | Zn: 0.4 | 0.85 | | | Ba: 0.2 | 0.2 |
| 147 | 0.05 | 2.49 | 0.02 | | | | Se: 0.05 | 0.05 | Sm: 0.001 | 0.001 | Rh: 0.03, Tc: 0.001 | 0.031 |
| 148 | 0.08 | — | 4.02 | 4.06 | B: 0.002 | Fe: 0.02, Si: 0.05 | | 0.07 | Ce: 0.002, Li0.1 | 0.102 | Cs: 0.001, Ba: 0.2 | 0.201 |
| 149 | 1.22 | — | 4.89 | 0.05 | | | | | La: 0.2 | 0.2 | Rb: 0.002, Bi: 0.2 | 0.202 |
| 150 | 2.21 | — | 2.03 | | | Mo: 0.01 | | 0.01 | | | Re: 0.001, Hf: 0.2 | 0.201 |
| 151 | 0.80 | 1.40 | — | | B: 0.01, S: 0.03 | Si: 0.3 | | 0.34 | | | Bi: 0.05 | 0.05 |
| 152 | 1.30 | 1.25 | — | | P: 0.01, S: 0.001 | Sn: 0.2 | Se: 0.1 | 0.31 | Ca: 0.01 | 0.01 | Pt: 0.01, In: 0.1 | 0.11 |
| 153 | 0.20 | 1.09 | 0.32 | | | Nb: 0.2 | Zn: 0.1 | 0.30 | Y: 0.02, La: 0.02 | 0.04 | Hf: 0.05, Pt: 0.09 | 0.14 |
| 154 | 1.01 | 1.35 | — | 0.05 | S: 0.5 | Si: 0.2, Sn: 0.2 | | 0.90 | Ca: 0.02 | 0.02 | Pt: 0.25, Ba: 0.03 | 0.28 |

*Out of the range regulated by the present invention.
Ms: Misch metal

Each of the resulting slabs was cooled from 900° C., that is the temperature just after casting (the temperature just after taken out of the mold), by water spray. The temperature change of the mold in a predetermined place was measured by a thermocouple buried in the mold, and the surface temperature of the slab, after leaving the mold, was measured in several areas by a contact type thermometer. The average cooling rate of the slab surface was calculated at 450° C. by using a thermal conduction analysis produced these results. In another small scale experiment, the solidification starting point was determined by using 0.2 g of a melt of each component, and thermally analyzing it during continuous cooling at a predetermined rate. A plate for subsequent rolling with a thickness of 10 mm× width 80 mm× length 150 mm was prepared from each resulting slab by cutting and chipping. For comparison, a part of the plate was subjected to a solution heat treatment at 950° C. The plates were rolled to 0.6 to 8.0 mm thick sheets by a reduction of 20 to 95% at a room temperature (first rolling), and further subjected to aging treatment under a predetermined condition (first aging). A part of the specimens were further subjected to rolling by a reduction of 40 to 95% (0.1 to 1.6 mm thickness) at a room temperature (second rolling) and then subjected to aging treatment under a predetermined condition (second aging). The production conditions thereof are shown in Tables 5 to 9. In Tables 5 to 9, the above-mentioned solution treatment was performed in Comparative Examples 6, 8, 10, 12, 14 and 16.

For the thus-produced specimens, the grain size and the total number per unit area of the precipitates and the intermetallics, tensile strength, electric conductivity, heat resisting temperature, and bending workability were measured by the following methods. These results are also shown in Tables 5 to 9.

<Total Number of Precipitates and Intermetallics>

A section parallel to the rolling plane and that perpendicular to the transverse direction of each specimen ware polish-finished, and a visual field of 1 mm×1 mm was observed by an optical microscope at 100-fold magnification intact or after being etched with an ammonia aqueous solution. Thereafter, the long diameter (the length of a straight line which can be drawn longest within a grain without contacting the grain boundary halfway) of the precipitates and the intermetallics was measured, and the resulting value is determined as grain size. When the measured value of the grain size of the precipitates and the intermetallics is 1.0 μm or more and less than 1.5 μm, X=1 is substituted to the formula (1), and when the measured value is (α−0.5) μm or more and less than (α+0.5) μm, X=α (α is an integer of 2 or more) can be substituted. Further, the total number $n_1$ is calculated by taking one crossing of the frame line of a visual field of 1 mm×1 mm as ½ and one located within the frame line as 1 for every grain size, and an average (N/10) of the number of the precipitates and the intermetallics N ($=n_1+n_2+\ldots+n_{10}$) in an optionally selected 10 visual fields is defined as the total number of the precipitates and the intermetallics for each grain size of the sample.

<Concentration Ratio>

A section of the alloy was polished and analyzed at random 10 times for a length of 50 μm by an X-ray analysis at 2000-fold magnification in order to determine the maximum values and minimum values of each alloy content in the respective line analyses. Averages of the maximum value and the minimum value were determined for eight values each after removing the two larger ones from the determined maximum values and minimum values, and the ratio thereof was calculated as the concentration ratio.

<Tensile Strength>

A specimen 13B regulated in JIS Z 2201 was prepared from the above-mentioned specimen so that the tensile direction is parallel to the rolling direction, and according to the method regulated in JIS Z 2241, tensile strength [TS (MPa)] at a room temperature (25° C.) thereof was determined.

<Electric Conductivity>

A specimen of width 10 mm× length 60 mm was prepared from the above-mentioned specimen so that the longitudinal direction is parallel to the rolling direction, and the potential difference between both ends of the specimen was measured by applying current in the longitudinal direction of the specimen, and the electric resistance was determined therefrom by a 4-terminal method. Successively, the electric resistance (resistivity) per unit volume was calculated from the volume of the specimen measured by a micrometer, and the electric conductivity [IACS (%)] was determined from the ratio to resistivity 1.72 μΩ·cm of a standard sample obtained by annealing a polycrystalline pure copper.

<Heat Resisting Temperature>

A specimen of width 100 m× length 10 mm was prepared from the above-mentioned specimen, a section vertical to the rolled surface and parallel to the rolling direction was polish-finished, a regular pyramidal diamond indenter was pushed into the specimen at a load of 50 g, and the Vickers hardness defined by the ratio of load to surface area of dent was measured. Further, after the specimen was heated at a predetermined temperature for 2 hours and cooled to a room temperature, the Vickers hardness was measured again, and a heating temperature, where the hardness is 50% of the hardness before heating, was regarded as the heat resisting temperature.

<Bending Workability>

A plurality of specimens of width 10 mm× length 60 mm were prepared from the above-mentioned specimen, and a 90° bending test was carried out while changing the curvature radius (inside diameter) of the bent part. After the test the bent parts of the specimens were observed from the outer diameter side by use of an optical microscope. A minimum curvature radius free from cracking was taken as R, and the ratio B (=R/t) of R to the thickness t of specimen was determined.

TABLE 5

| | | | Production Condition | | | | | | | | | | | Characteristics | | | | | |
|---|---|---|---|---|---|---|---|---|---|---|---|---|---|---|---|---|---|---|---|
| | | | Cooling | 1st Rolling | | 1st Heat Treatment | | 2nd Rolling | | 2nd Heat Treatment | | | | | Tensile | | Heat Resisting | Bending Workability | |
| Division | | Alloy No. | Rate (° C./s) | Temp. (° C.) | Thickness (mm) | Temp. (° C.) | Time | Temp. (° C.) | Thickness (mm) | Temp. (° C.) | Time | ① | ② | Grain Size (μm) | Strength (MPa) | Conductivity (%) | Temp. (° C.) | B (R/t) | Evaluation |
| Examples of The Present Invention | 1 | 5 | 11 | 25 | 2.0 | 400 | 2 h | 25 | 0.1 | 350 | 10 h | ◎ | 5.6(Ti) | 30 | 710 | 60 | 500 | 1 | ○ |
| | 2 | 6 | 10 | 25 | 2.0 | 400 | 2 h | 25 | 0.1 | 350 | 10 h | ◎ | 2.5(Ti) | 20 | 900 | 40 | 450 | 2 | ○ |
| | 3 | 7 | 12 | 25 | 2.1 | 400 | 2 h | 25 | 0.1 | 350 | 10 h | ◎ | 11.5(Ti) | 18 | 1178 | 20 | 450 | 3 | ○ |
| | 4 | 8 | 11 | 25 | 1.9 | 400 | 2 h | 25 | 0.1 | 350 | 10 h | ○ | 8.8(Cr) | 10 | 1350 | 10 | 450 | 5 | ○ |
| | 5 | 9 | 9 | 25 | 2.0 | 400 | 2 h | 25 | 0.1 | 350 | 10 h | ◎ | 2.8(Cr) | 22 | 805 | 70 | 500 | 1 | ○ |
| | 6 | 10 | 10 | 25 | 1.9 | 400 | 2 h | 25 | 0.1 | 350 | 10 h | ◎ | — | 19 | 880 | 65 | 450 | 1 | ○ |
| | 7 | 11 | 11 | 25 | 1.8 | 400 | 2 h | 25 | 0.1 | 350 | 10 h | ○ | — | 0.9 | 1305 | 15 | 500 | 4 | ○ |
| | 8 | 12 | 9 | 25 | 2.0 | 400 | 2 h | 25 | 0.1 | 350 | 10 h | ◎ | 4.5(Cr) | 10 | 750 | 75 | 500 | 1 | ○ |
| | 9 | 13 | 10 | 25 | 2.0 | 400 | 2 h | 25 | 0.1 | 350 | 10 h | ◎ | — | 20 | 915 | 31 | 500 | 2 | ○ |
| | 10 | 14 | 11 | 25 | 2.0 | 400 | 2 h | 25 | 0.1 | 350 | 10 h | ◎ | 3.5(Cr) | 32 | 750 | 62 | 500 | 1 | ○ |
| | 11 | 15 | 12 | 25 | 1.9 | 400 | 2 h | 25 | 0.1 | 350 | 10 h | ◎ | — | 10 | 920 | 31 | 500 | 2 | ○ |
| | 12 | 16 | 11 | 25 | 2.0 | 400 | 2 h | 25 | 0.1 | 350 | 10 h | ◎ | — | 3 | 1180 | 18 | 500 | 2 | ○ |
| | 13 | 17 | 9 | 25 | 2.1 | 400 | 2 h | 25 | 0.1 | 350 | 10 h | ○ | — | 0 | 1250 | 11 | 500 | 2 | ○ |
| | 14 | 18 | 10 | 25 | 2.1 | 400 | 2 h | 25 | 0.1 | 350 | 10 h | ◎ | — | 32 | 750 | 62 | 500 | 1 | ○ |
| | 15 | 19 | 10 | 25 | 2.0 | 400 | 2 h | 25 | 0.1 | 350 | 10 h | ◎ | — | 12 | 925 | 35 | 500 | 2 | ○ |
| | 16 | 20 | 11 | 25 | 1.9 | 400 | 2 h | 25 | 0.1 | 350 | 10 h | ○ | — | 10 | 1362 | 18 | 500 | 5 | ○ |
| | 17 | 21 | 12 | 25 | 1.9 | 400 | 2 h | 25 | 0.1 | 350 | 10 h | Δ | — | 0.8 | 1450 | 14 | 500 | 6 | ○ |
| | 18 | 21 | 10 | 25 | 2.1 | 400 | 2 h | 25 | 0.2 | — | — | ○ | 4.8(Zr) | 0.1 | 1390 | 10 | 450 | 4 | ○ |
| | 19 | 22 | 10 | 25 | 2.0 | 400 | 2 h | 25 | 0.1 | 350 | 10 h | ◎ | 3.5(Ti) | 31 | 761 | 52 | 500 | 1 | ○ |
| | 20 | 23 | 10 | 25 | 2.0 | 400 | 2 h | 25 | 0.1 | 350 | 10 h | ◎ | — | 21 | 930 | 34 | 500 | 2 | ○ |
| | 21 | 24 | 9 | 25 | 2.1 | 400 | 2 h | 25 | 0.1 | 350 | 10 h | ○ | — | 5 | 1365 | 29 | 500 | 4 | ○ |
| | 22 | 24 | 9 | 25 | 1.9 | 400 | 2 h | 25 | 0.2 | — | — | ◎ | — | 1 | 1192 | 20 | 450 | 2 | ○ |
| | 23 | 25 | 10 | 25 | 1.9 | 400 | 2 h | 25 | 0.1 | 350 | 10 h | Δ | — | 0.5 | 1482 | 15 | 500 | 6 | ○ |
| | 24 | 26 | 11 | 25 | 1.9 | 400 | 2 h | 25 | 0.1 | 350 | 10 h | ◎ | — | 34 | 785 | 48 | 500 | 1 | ○ |
| | 25 | 27 | 11 | 25 | 1.9 | 400 | 2 h | 25 | 0.1 | 350 | 10 h | ◎ | — | 26 | 934 | 35 | 500 | 2 | ○ |
| | 26 | 28 | 12 | 25 | 1.9 | 400 | 2 h | 25 | 0.1 | 350 | 10 h | ◎ | — | 19 | 970 | 31 | 500 | 2 | ○ |
| | 27 | 29 | 11 | 25 | 1.9 | 400 | 2 h | 25 | 0.1 | 350 | 10 h | Δ | — | 0.1 | 1492 | 14 | 500 | 6 | ○ |
| | 28 | 30 | 9 | 25 | 2.0 | 400 | 2 h | 25 | 0.1 | 350 | 10 h | ◎ | 3.5(Zr) | 30 | 789 | 47 | 500 | 1 | ○ |
| | 29 | 31 | 10 | 25 | 2.0 | 400 | 2 h | 25 | 0.1 | 350 | 10 h | ◎ | — | 17 | 941 | 28 | 500 | 2 | ○ |
| | 30 | 32 | 10 | 25 | 2.0 | 400 | 2 h | 25 | 0.1 | 350 | 10 h | ○ | — | 1 | 1210 | 15 | 500 | 4 | ○ |
| | 31 | 33 | 10 | 25 | 2.0 | 400 | 2 h | 25 | 0.1 | 350 | 10 h | ○ | — | 0.8 | 1376 | 10 | 500 | 5 | ○ |
| | 32 | 34 | 9 | 25 | 2.0 | 400 | 2 h | 25 | 0.1 | 350 | 10 h | Δ | 3.0(Ti) | 0.02 | 1520 | 5 | 500 | 7 | ○ |
| | 33 | 35 | 10 | 25 | 2.0 | 400 | 2 h | 25 | 0.1 | 350 | 10 h | ◎ | — | 21 | 850 | 45 | 500 | 2 | ○ |
| | 34 | 36 | 11 | 25 | 2.1 | 400 | 2 h | 25 | 0.1 | 350 | 10 h | ◎ | 3.9(Zr) | 5 | 1080 | 46 | 500 | 3 | ○ |
| | 35 | 37 | 11 | 25 | 2.1 | 400 | 2 h | 25 | 0.1 | 350 | 10 h | ◎ | — | 2 | 1142 | 30 | 500 | 3 | ○ |

"h" in "Time" means hour.

"Δ", "○" and "◎" in ① mean that formulas (1), (2) and (3) are satisfied, respectively.

② means "content maximum value/content minimum value". Object element is shown in parentheses.

TABLE 6

| | | | Production Condition | | | | | | | | | | | Characteristics | | | | | |
|---|---|---|---|---|---|---|---|---|---|---|---|---|---|---|---|---|---|---|---|
| | | | Cooling | 1st Rolling | | 1st Heat Treatment | | 2nd Rolling | | 2nd Heat Treatment | | | | | Tensile | | Heat Resisting | Bending Workability | |
| Division | | Alloy No. | Rate (° C./s) | Temp. (° C.) | Thickness (mm) | Temp. (° C.) | Time | Temp. (° C.) | Thickness (mm) | Temp. (° C.) | Time | ① | ② | Grain Size (μm) | Strength (MPa) | Conductivity (%) | Temp. (° C.) | B (R/t) | Evaluation |
| Examples of The Present Invention | 36 | 38 | 12 | 25 | 1.9 | 400 | 2 h | 25 | 0.1 | 350 | 10 h | ◎ | 3.0(Ti) | 29 | 750 | 60 | 500 | 1 | ○ |
| | 37 | 39 | 10 | 25 | 2.1 | 400 | 2 h | 25 | 0.1 | 350 | 10 h | ◎ | — | 12 | 854 | 45 | 500 | 2 | ○ |
| | 38 | 40 | 9 | 25 | 1.9 | 400 | 2 h | 25 | 0.1 | 350 | 10 h | ◎ | — | 6 | 1000 | 30 | 500 | 2 | ○ |
| | 39 | 41 | 10 | 25 | 1.9 | 400 | 2 h | 25 | 0.1 | 350 | 10 h | ◎ | — | 1 | 1180 | 22 | 500 | 3 | ○ |
| | 40 | 42 | 10 | 25 | 2.0 | 400 | 2 h | 25 | 0.1 | 350 | 10 h | ◎ | 3.5(Cr) | 30 | 720 | 60 | 500 | 1 | ○ |
| | 41 | 43 | 9 | 25 | 1.9 | 400 | 2 h | 25 | 0.1 | 350 | 10 h | ◎ | — | 19 | 842 | 41 | 500 | 2 | ○ |
| | 42 | 44 | 9 | 25 | 1.9 | 400 | 2 h | 25 | 0.1 | 350 | 10 h | ◎ | — | 12 | 998 | 30 | 500 | 2 | ○ |
| | 43 | 45 | 10 | 25 | 2.0 | 400 | 2 h | 25 | 0.1 | 350 | 10 h | ◎ | — | 1 | 1123 | 29 | 500 | 3 | ○ |
| | 44 | 46 | 12 | 25 | 2.0 | 400 | 2 h | 25 | 0.1 | 350 | 10 h | ◎ | 4.2(Cr) | 34 | 780 | 55 | 500 | 1 | ○ |
| | 45 | 47 | 10 | 25 | 2.0 | 400 | 2 h | 25 | 0.1 | 350 | 10 h | ◎ | — | 16 | 850 | 42 | 500 | 2 | ○ |
| | 46 | 48 | 10 | 25 | 2.0 | 400 | 2 h | 25 | 0.1 | 350 | 10 h | ◎ | — | 5 | 1002 | 28 | 500 | 2 | ○ |
| | 47 | 49 | 11 | 25 | 1.9 | 400 | 2 h | 25 | 0.1 | 350 | 10 h | ○ | — | 0.2 | 1200 | 21 | 500 | 4 | ○ |
| | 48 | 61 | 11 | 25 | 2.0 | 400 | 2 h | 25 | 0.1 | 350 | 10 h | ◎ | — | 16 | 1120 | 31 | 550 | 3 | ○ |
| | 49 | 62 | 12 | 25 | 2.0 | 400 | 2 h | 25 | 0.1 | 350 | 10 h | ◎ | — | 5 | 1062 | 35 | 450 | 3 | ○ |
| | 50 | 63 | 10 | 25 | 2.1 | 400 | 2 h | 25 | 0.1 | 350 | 10 h | ◎ | 2.9(Ti), 1.5(Sn) | 1 | 1075 | 27 | 450 | 3 | ○ |
| | 51 | 64 | 11 | 25 | 1.9 | 400 | 2 h | 25 | 0.1 | 350 | 10 h | ◎ | — | 12 | 970 | 40 | 450 | 2 | ○ |
| | 52 | 65 | 10 | 25 | 2.0 | 400 | 2 h | 25 | 0.1 | 350 | 10 h | ◎ | 3.2(Fe), 1.8(Cr) | 15 | 975 | 33 | 500 | 2 | ○ |
| | 53 | 66 | 9 | 25 | 1.9 | 400 | 2 h | 25 | 0.1 | 350 | 10 h | ◎ | — | 3 | 1061 | 28 | 500 | 3 | ○ |
| | 54 | 67 | 10 | 25 | 1.8 | 400 | 2 h | 25 | 0.1 | 350 | 10 h | ◎ | — | 1 | 1059 | 29 | 500 | 3 | ○ |
| | 55 | 68 | 10 | 25 | 1.8 | 400 | 2 h | 25 | 0.1 | 350 | 10 h | ◎ | — | 12 | 954 | 35 | 450 | 2 | ○ |
| | 56 | 69 | 10 | 25 | 2.0 | 400 | 2 h | 25 | 0.1 | 350 | 10 h | ◎ | — | 0.9 | 1052 | 28 | 450 | 3 | ○ |
| | 57 | 70 | 11 | 25 | 2.0 | 400 | 2 h | 25 | 0.1 | 350 | 10 h | ◎ | — | 1 | 1049 | 28 | 450 | 3 | ○ |
| | 58 | 71 | 10 | 25 | 1.9 | 400 | 2 h | 25 | 0.1 | 350 | 10 h | ◎ | — | 3 | 1058 | 27 | 450 | 3 | ○ |
| | 59 | 72 | 10 | 25 | 2.0 | 400 | 2 h | 25 | 0.1 | 350 | 10 h | ◎ | — | 2 | 1055 | 29 | 450 | 3 | ○ |
| | 60 | 73 | 10 | 25 | 2.0 | 400 | 2 h | 25 | 0.1 | 350 | 10 h | ◎ | — | 3 | 1002 | 32 | 450 | 2 | ○ |
| | 61 | 74 | 9 | 25 | 1.9 | 400 | 2 h | 25 | 0.1 | 350 | 10 h | ◎ | — | 2 | 1045 | 35 | 550 | 3 | ○ |
| | 62 | 75 | 10 | 25 | 2.0 | 400 | 2 h | 25 | 0.1 | 350 | 10 h | ◎ | — | 2 | 1028 | 32 | 500 | 2 | ○ |
| | 63 | 76 | 10 | 25 | 2.1 | 400 | 2 h | 25 | 0.1 | 350 | 10 h | ◎ | 4.2(V), 3.2(Ti) | 2 | 1062 | 27 | 450 | 2 | ○ |
| | 64 | 77 | 10 | 25 | 2.1 | 400 | 2 h | 25 | 0.1 | 350 | 10 h | ◎ | — | 12 | 950 | 42 | 450 | 2 | ○ |
| | 65 | 78 | 11 | 25 | 2.0 | 400 | 2 h | 25 | 0.1 | 350 | 10 h | ◎ | — | 2 | 1061 | 27 | 450 | 3 | ○ |
| | 66 | 79 | 11 | 25 | 1.9 | 400 | 2 h | 25 | 0.1 | 350 | 10 h | ◎ | — | 9 | 1006 | 29 | 550 | 2 | ○ |
| | 67 | 80 | 12 | 25 | 1.9 | 400 | 2 h | 25 | 0.1 | 350 | 10 h | ◎ | — | 12 | 954 | 35 | 450 | 2 | ○ |
| | 68 | 81 | 11 | 25 | 2.0 | 400 | 2 h | 25 | 0.1 | 350 | 10 h | ◎ | — | 3 | 1056 | 28 | 450 | 3 | ○ |
| | 69 | 82 | 10 | 25 | 2.0 | 400 | 2 h | 25 | 0.1 | 350 | 10 h | ◎ | — | 2 | 1002 | 32 | 500 | 2 | ○ |
| | 70 | 83 | 9 | 25 | 2.1 | 400 | 2 h | — | — | — | — | ◎ | 3.2(Ti), 1.9(Zn) | 25 | 880 | 40 | 450 | 2 | ○ |

"h" in "Time" means hour.

"○" and "◎" in ① mean that formulas (2) and (3) are satisfied, respectively.

② means "content maximum value/content minimum value". Object element is shown in parentheses.

TABLE 7

| Division | | Alloy No. | Production Condition: Cooling Rate (° C./s) | 1st Rolling Temp. (° C.) | 1st Rolling Thickness (mm) | 1st Heat Treatment Temp. (° C.) | 1st Heat Treatment Time | 2nd Rolling Temp. (° C.) | 2nd Rolling Thickness (mm) | 2nd Heat Treatment Temp. (° C.) | 2nd Heat Treatment Time | ① | ② | Characteristics: Grain Size (μm) | Tensile Strength (MPa) | Tensile Conductivity (%) | Heat Resisting Temp. (° C.) | Bending Workability B (R/t) | Bending Workability Evaluation |
|---|---|---|---|---|---|---|---|---|---|---|---|---|---|---|---|---|---|---|---|
| Examples of The Present Invention | 71 | 84 | 10 | 25 | 1.9 | 400 | 2 h | 25 | 0.1 | 350 | 10 h | ◎ | — | 5 | 1058 | 29 | 450 | 3 | ○ |
| | 72 | 85 | 10 | 25 | 1.9 | 400 | 2 h | 25 | 0.1 | 350 | 10 h | ◎ | — | 3 | 1059 | 28 | 500 | 3 | ○ |
| | 73 | 86 | 11 | 25 | 1.9 | 400 | 2 h | 25 | 0.1 | 350 | 10 h | ◎ | — | 4 | 1056 | 28 | 500 | 3 | ○ |
| | 74 | 87 | 10 | 25 | 1.9 | 400 | 2 h | 25 | 0.1 | 350 | 10 h | ◎ | — | 8 | 1043 | 28 | 500 | 3 | ○ |
| | 75 | 88 | 11 | 25 | 1.9 | 400 | 2 h | 25 | 0.1 | 350 | 10 h | ◎ | — | 2 | 1056 | 30 | 500 | 3 | ○ |
| | 76 | 89 | 11 | 25 | 2.0 | 400 | 2 h | 25 | 0.1 | 350 | 10 h | ◎ | — | 5 | 1006 | 34 | 500 | 2 | ○ |
| | 77 | 90 | 12 | 25 | 2.0 | 400 | 2 h | 25 | 0.1 | 350 | 10 h | ◎ | — | 1 | 1059 | 28 | 500 | 3 | ○ |
| | 78 | 91 | 11 | 25 | 2.0 | 400 | 2 h | 25 | 0.1 | 350 | 10 h | ◎ | — | 1 | 1059 | 29 | 500 | 3 | ○ |
| | 79 | 92 | 11 | 25 | 2.0 | 400 | 2 h | 25 | 0.1 | 350 | 10 h | ◎ | — | 1.3 | 1123 | 25 | 600 | 3 | ○ |
| | 80 | 93 | 10 | 25 | 2.0 | 400 | 2 h | 25 | 0.1 | 350 | 10 h | ◎ | — | 21 | 982 | 45 | 500 | 2 | ○ |
| | 81 | 94 | 10 | 25 | 2.0 | 400 | 2 h | 25 | 0.1 | 350 | 10 h | ◎ | — | 1 | 1067 | 28 | 500 | 3 | ○ |
| | 82 | 95 | 9 | 25 | 2.1 | 400 | 2 h | 25 | 0.1 | 350 | 10 h | ◎ | 3.5(Ti), 1.6(Al) | 1 | 1058 | 29 | 500 | 3 | ○ |
| | 83 | 96 | 12 | 25 | 2.1 | 400 | 2 h | 25 | 0.1 | 350 | 10 h | ◎ | — | 12 | 978 | 32 | 500 | 2 | ○ |
| | 84 | 97 | 10 | 25 | 1.9 | 400 | 2 h | 25 | 0.1 | 350 | 10 h | ◎ | — | 2 | 1082 | 26 | 500 | 3 | ○ |
| | 85 | 98 | 11 | 25 | 2.1 | 400 | 2 h | 25 | 0.1 | 350 | 10 h | ◎ | — | 3 | 1055 | 28 | 500 | 3 | ○ |
| | 86 | 99 | 10 | 25 | 1.9 | 400 | 2 h | 25 | 0.1 | 350 | 10 h | ◎ | — | 5 | 1056 | 28 | 500 | 3 | ○ |
| | 87 | 100 | 10 | 25 | 1.9 | 400 | 2 h | 25 | 0.1 | 350 | 10 h | ◎ | — | 5 | 1050 | 29 | 500 | 3 | ○ |
| | 88 | 101 | 9 | 25 | 2.0 | 400 | 2 h | 25 | 0.1 | 350 | 10 h | ◎ | — | 2 | 1062 | 27 | 500 | 3 | ○ |
| | 89 | 102 | 10 | 25 | 1.9 | 400 | 2 h | 25 | 0.1 | 350 | 10 h | ◎ | — | 11 | 980 | 33 | 500 | 2 | ○ |
| | 90 | 103 | 11 | 25 | 1.9 | 400 | 2 h | 25 | 0.1 | 350 | 10 h | ◎ | — | 19 | 992 | 35 | 500 | 2 | ○ |
| | 91 | 104 | 10 | 25 | 2.0 | 400 | 2 h | 25 | 0.1 | 350 | 10 h | ◎ | — | 3 | 1060 | 28 | 500 | 3 | ○ |
| | 92 | 105 | 9 | 25 | 2.0 | 400 | 2 h | 25 | 0.1 | 350 | 10 h | ◎ | — | 4 | 1055 | 28 | 500 | 3 | ○ |
| | 93 | 106 | 10 | 25 | 2.0 | 400 | 2 h | 25 | 0.1 | 350 | 10 h | ◎ | — | 18 | 992 | 32 | 500 | 2 | ○ |
| | 94 | 107 | 10 | 25 | 2.0 | 400 | 2 h | 25 | 0.1 | 350 | 10 h | ◎ | — | 21 | 960 | 35 | 500 | 2 | ○ |
| | 95 | 108 | 11 | 25 | 1.9 | 400 | 2 h | 25 | 0.1 | 350 | 10 h | ◎ | 2.5(Ti), 1.8(Si) | 5 | 1058 | 29 | 500 | 3 | ○ |
| | 96 | 109 | 10 | 25 | 2.1 | 400 | 2 h | 25 | 0.1 | 350 | 10 h | ◎ | — | 1 | 1100 | 27 | 500 | 3 | ○ |
| | 97 | 110 | 9 | 25 | 1.9 | 400 | 2 h | 25 | 0.1 | 350 | 10 h | ◎ | — | 16 | 980 | 33 | 500 | 2 | ○ |
| | 98 | 111 | 10 | 25 | 2.0 | 400 | 2 h | 25 | 0.1 | 350 | 10 h | ◎ | — | 22 | 950 | 35 | 500 | 2 | ○ |
| | 99 | 112 | 10 | 25 | 2.0 | 400 | 2 h | 25 | 0.1 | 350 | 10 h | ◎ | — | 14 | 982 | 32 | 500 | 2 | ○ |
| | 100 | 113 | 10 | 25 | 1.9 | 400 | 2 h | 25 | 0.1 | 350 | 10 h | ◎ | — | 8 | 1000 | 32 | 500 | 2 | ○ |
| | 101 | 114 | 11 | 25 | 2.1 | 400 | 2 h | 25 | 0.1 | 350 | 10 h | ◎ | — | 12 | 1005 | 62 | 500 | 2 | ○ |
| | 102 | 115 | 12 | 25 | 2.1 | 400 | 2 h | 25 | 0.1 | 350 | 10 h | ◎ | — | 15 | 984 | 35 | 500 | 2 | ○ |
| | 103 | 116 | 11 | 25 | 2.0 | 400 | 2 h | 25 | 0.1 | 350 | 10 h | ◎ | — | 21 | 962 | 43 | 550 | 2 | ○ |
| | 104 | 117 | 11 | 25 | 2.0 | 400 | 2 h | 25 | 0.1 | 350 | 10 h | ◎ | — | 15 | 1005 | 35 | 550 | 2 | ○ |
| | 105 | 118 | 11 | 25 | 1.9 | 400 | 2 h | 25 | 0.1 | 350 | 10 h | ◎ | — | 18 | 990 | 28 | 500 | 2 | ○ |

"h" in "Time" means hour.

"◎" in ① means that formula (3) is satisfied.

② means "content maximum value/element minimum value". Object element is shown in parentheses.

TABLE 8

| Division | | Alloy No. | Production Condition: Cooling Rate (° C./s) | 1st Rolling Temp. (° C.) | 1st Rolling Thickness (mm) | 1st Heat Treatment Temp. (° C.) | 1st Heat Treatment Time | 2nd Rolling Temp. (° C.) | 2nd Rolling Thickness (mm) | 2nd Heat Treatment Temp. (° C.) | 2nd Heat Treatment Time | ① | ② | Characteristics: Grain Size (μm) | Tensile Strength (MPa) | Tensile Conductivity (%) | Heat Resisting Temp. (° C.) | Bending Workability B (R/t) | Bending Workability Evaluation |
|---|---|---|---|---|---|---|---|---|---|---|---|---|---|---|---|---|---|---|---|
| Examples of The Present Invention | 106 | 119 | 10 | 25 | 1.9 | 400 | 2 h | 25 | 0.1 | 350 | 10 h | ◎ | — | 18 | 979 | 34 | 500 | 2 | ○ |
| | 107 | 120 | 9 | 25 | 2.0 | 400 | 2 h | 25 | 0.1 | 350 | 10 h | ◎ | — | 15 | 980 | 36 | 500 | 2 | ○ |
| | 108 | 121 | 10 | 25 | 2.0 | 400 | 2 h | 25 | 0.1 | 350 | 10 h | ◎ | — | 14 | 980 | 34 | 500 | 2 | ○ |
| | 109 | 122 | 10 | 25 | 2.0 | 400 | 2 h | 25 | 0.1 | 350 | 10 h | ◎ | 2.8(Co), 1.9(Zr) | 11 | 992 | 32 | 500 | 2 | ○ |
| | 110 | 123 | 10 | 25 | 2.1 | 400 | 2 h | 25 | 0.1 | 350 | 10 h | ◎ | — | 16 | 985 | 31 | 500 | 2 | ○ |
| | 111 | 124 | 11 | 25 | 2.0 | 400 | 2 h | 25 | 0.1 | 350 | 10 h | ◎ | — | 18 | 992 | 34 | 550 | 2 | ○ |
| | 112 | 125 | 11 | 25 | 2.0 | 400 | 2 h | 25 | 0.1 | 350 | 10 h | ◎ | — | 9 | 1001 | 30 | 500 | 2 | ○ |
| | 113 | 126 | 10 | 25 | 2.1 | 400 | 2 h | 25 | 0.1 | 350 | 10 h | ◎ | — | 13 | 993 | 31 | 500 | 2 | ○ |
| | 114 | 127 | 12 | 25 | 1.9 | 400 | 2 h | 25 | 0.1 | 350 | 10 h | ◎ | — | 7 | 1012 | 30 | 500 | 2 | ○ |
| | 115 | 128 | 10 | 25 | 1.9 | 400 | 2 h | 25 | 0.1 | 350 | 10 h | ◎ | — | 19 | 950 | 48 | 500 | 2 | ○ |
| | 116 | 129 | 11 | 25 | 2.0 | 400 | 2 h | 25 | 0.1 | 350 | 10 h | ◎ | — | 8 | 970 | 46 | 600 | 2 | ○ |
| | 117 | 130 | 12 | 25 | 2.1 | 400 | 2 h | 25 | 0.1 | 350 | 10 h | ◎ | — | 1 | 1180 | 25 | 500 | 3 | ○ |
| | 118 | 131 | 10 | 25 | 2.0 | 400 | 2 h | 25 | 0.1 | 350 | 10 h | ◎ | — | 13 | 960 | 33 | 500 | 2 | ○ |
| | 119 | 132 | 11 | 25 | 2.0 | 400 | 2 h | 25 | 0.1 | 350 | 10 h | ◎ | — | 12 | 983 | 34 | 500 | 2 | ○ |
| | 120 | 133 | 10 | 25 | 2.0 | 400 | 2 h | 25 | 0.1 | 350 | 10 h | ◎ | — | 24 | 920 | 43 | 500 | 2 | ○ |
| | 121 | 50 | 10 | 25 | 2.1 | 400 | 2 h | 25 | 0.1 | 350 | 10 h | ◎ | — | 30 | 601 | 62 | 450 | 1 | ○ |
| | 122 | 51 | 11 | 25 | 2.0 | 400 | 2 h | 25 | 0.1 | 350 | 10 h | ◎ | — | 32 | 600 | 80 | 450 | 1 | ○ |
| | 123 | 52 | 11 | 25 | 2.0 | 400 | 2 h | 25 | 0.1 | 350 | 10 h | ◎ | — | 28 | 861 | 20 | 450 | 1 | ○ |
| | 124 | 53 | 9 | 25 | 1.9 | 400 | 2 h | 25 | 0.1 | 350 | 10 h | ◎ | 1.5(Ag) | 32 | 605 | 58 | 450 | 1 | ○ |
| | 125 | 54 | 11 | 25 | 2.0 | 400 | 2 h | 25 | 0.1 | 350 | 10 h | ◎ | — | 30 | 598 | 60 | 450 | 1 | ○ |
| | 126 | 55 | 9 | 25 | 2.0 | 400 | 2 h | 25 | 0.1 | 350 | 10 h | ◎ | — | 28 | 604 | 59 | 450 | 1 | ○ |
| | 127 | 56 | 11 | 25 | 2.1 | 400 | 2 h | 25 | 0.1 | 350 | 10 h | ◎ | — | 30 | 608 | 55 | 450 | 1 | ○ |
| | 128 | 57 | 10 | 25 | 2.0 | 400 | 2 h | 25 | 0.1 | 350 | 10 h | ○ | — | 20 | 1201 | 10 | 450 | 3 | ○ |
| | 129 | 58 | 10 | 25 | 2.0 | 400 | 2 h | 25 | 0.1 | 350 | 10 h | ◎ | — | 28 | 861 | 23 | 450 | 2 | ○ |
| | 130 | 59 | 11 | 25 | 2.0 | 400 | 2 h | 25 | 0.1 | 350 | 10 h | ◎ | — | 25 | 940 | 18 | 450 | 2 | ○ |
| | 131 | 60 | 11 | 25 | 1.9 | 400 | 2 h | 25 | 0.1 | 350 | 10 h | ○ | 8.0(Zr) | 18 | 1210 | 9 | 450 | 3 | ○ |
| | 132 | 141 | 11 | 25 | 2.0 | 400 | 2 h | 25 | 0.1 | 350 | 10 h | ◎ | — | 25 | 946 | 45 | 550 | 2 | ○ |
| | 133 | 142 | 10 | 25 | 2.0 | 400 | 2 h | 25 | 0.1 | 350 | 10 h | ◎ | — | 29 | 857 | 42 | 450 | 2 | ○ |
| | 134 | 143 | 10 | 25 | 2.0 | 400 | 2 h | 25 | 0.1 | 350 | 10 h | ◎ | — | 30 | 771 | 52 | 550 | 1 | ○ |
| | 135 | 144 | 10 | 25 | 1.9 | 400 | 2 h | 25 | 0.1 | 350 | 10 h | ◎ | — | 32 | 911 | 49 | 550 | 1 | ○ |
| | 136 | 145 | 11 | 25 | 2.0 | 400 | 2 h | 25 | 0.1 | 350 | 10 h | ◎ | — | 32 | 871 | 43 | 450 | 1 | ○ |
| | 137 | 146 | 9 | 25 | 2.0 | 400 | 2 h | 25 | 0.1 | 350 | 10 h | ◎ | — | 24 | 944 | 52 | 450 | 2 | ○ |
| | 138 | 147 | 10 | 25 | 2.0 | 400 | 2 h | 25 | 0.1 | 350 | 10 h | ◎ | — | 19 | 1028 | 32 | 550 | 2 | ○ |
| | 139 | 148 | 10 | 25 | 1.9 | 400 | 2 h | 25 | 0.1 | 350 | 10 h | ○ | — | 30 | 1295 | 21 | 550 | 2 | ○ |
| | 140 | 149 | 10 | 25 | 2.0 | 400 | 2 h | 25 | 0.1 | 350 | 10 h | Δ | — | 10 | 1467 | 7 | 600 | 4 | ○ |
| | 141 | 150 | 11 | 25 | 2.0 | 400 | 2 h | 25 | 0.1 | 350 | 10 h | ◎ | — | 15 | 948 | 43 | 450 | 3 | ○ |
| | 142 | 151 | 10 | 25 | 2.0 | 400 | 2 h | 25 | 0.1 | 350 | 10 h | ◎ | — | 20 | 1037 | 25 | 450 | 2 | ○ |
| | 143 | 152 | 11 | 25 | 1.9 | 400 | 2 h | 25 | 0.1 | 350 | 10 h | ◎ | — | 18 | 1009 | 28 | 500 | 2 | ○ |
| | 144 | 153 | 9 | 25 | 2.0 | 400 | 2 h | 25 | 0.1 | 350 | 10 h | ◎ | — | 25 | 1039 | 24 | 550 | 2 | ○ |
| | 145 | 154 | 10 | 25 | 1.9 | 400 | 2 h | 25 | 0.1 | 350 | 10 h | ◎ | — | 15 | 1028 | 26 | 500 | 2 | ○ |

"h" in "Time" means hour. "Δ", "○" and "◎" in ① mean that formula (1), (2) and (3) are satisfied, respectively. ② means "content maximum value/content minimum value". Object element is shown in parentheses.

TABLE 9

| Division | | Alloy No. | Production Condition: Cooling Rate (° C./s) | 1st Rolling Temp. (° C.) | 1st Rolling Thickness (mm) | 1st Heat Treatment Temp. (° C.) | 1st Heat Treatment Time | 2nd Rolling Temp. (° C.) | 2nd Rolling Thickness (mm) | 2nd Heat Treatment Temp. (° C.) | 2nd Heat Treatment Time |
|---|---|---|---|---|---|---|---|---|---|---|---|
| Comparative Examples | 1 | 1# | 10 | 25 | 2.0 | 400 | 2 h | 25 | 0.1 | 350 | 10 h |
| | 2 | 2# | 9 | 25 | 1.9 | 400 | 2 h | 25 | 0.1 | — | — |
| | 3 | 3# | 10 | 25 | 1.8 | 400 | 2 h | 25 | 0.1 | 350 | 10 h |
| | 4 | 4# | 11 | 25 | 1.8 | 400 | 2 h | 25 | 0.1 | 350 | 10 h |
| | 5 | 9 | 0.2* | 25 | 2.0 | 400 | 2 h | 25 | 0.1 | 350 | 10 h |
| | 6 | 9 | 10 | 25 | 2.0 | 400 | 2 h | 25 | 0.1 | 350 | 10 h |
| | 7 | 24 | 0.2* | 25 | 2.1 | 400 | 2 h | 25 | 0.1 | 350 | 10 h |
| | 8 | 24 | 10 | 25 | 2.1 | 400 | 2 h | 25 | 0.1 | 350 | 10 h |
| | 9 | 39 | 0.2* | 25 | 2.0 | 400 | 2 h | 25 | 0.1 | 350 | 10 h |
| | 10 | 39 | 9 | 25 | 2.0 | 400 | 2 h | 25 | 0.1 | 350 | 10 h |
| | 11 | 41 | 0.2* | 25 | 2.0 | 400 | 2 h | 25 | 0.1 | 350 | 10 h |
| | 12 | 41 | 10 | 25 | 2.0 | 400 | 2 h | 25 | 0.1 | 350 | 10 h |
| | 13 | 62 | 0.2* | 25 | 2.1 | 400 | 2 h | 25 | 0.1 | 350 | 10 h |
| | 14 | 62 | 11 | 25 | 2.1 | 400 | 2 h | 25 | 0.1 | 350 | 10 h |
| | 15 | 98 | 0.2* | 25 | 1.9 | 400 | 2 h | 25 | 0.1 | 350 | 10 h |
| | 16 | 98 | 10 | 25 | 1.9 | 400 | 2 h | 25 | 0.1 | 350 | 10 h |
| | 17 | 134# | 9 | 25 | 2.0 | 400 | 2 h | 25 | 0.1 | 350 | 10 h |
| | 18 | 135# | 10 | 25 | 1.9 | 400 | 2 h | 25 | 0.1 | 350 | 10 h |
| | 19 | 136# | 11 | 25 | 1.9 | 400 | 2 h | 25 | 0.1 | 350 | 10 h |
| | 20 | 137# | 10 | 25 | 2.1 | 400 | 2 h | 25 | 0.1 | 350 | 10 h |
| | 21 | 138# | 10 | 25 | 2.0 | 400 | 2 h | 25 | 0.1 | 350 | 10 h |
| | 22 | 129# | 11 | 25 | 2.1 | 400 | 2 h | 25 | 0.1 | 350 | 10 h |
| | 23 | 140# | 11 | 25 | 2.0 | 400 | 2 h | 25 | 0.1 | — | — |

| Division | | ① | ② | Characteristics: Grain Size (μm) | Tensile Strength (MPa) | Conductivity (%) | Heat Resisting Temp. (° C.) | Bending Workability B (R/t) | Bending Workability Evaluation |
|---|---|---|---|---|---|---|---|---|---|
| Comparative Examples | 1 | X | — | 81 | 623 | 41 | 500 | 3 | X |
| | 2 | X | — | — | — | — | — | — | — |
| | 3 | X | — | 35 | 1000 | 15 | 350 | 5 | X |
| | 4 | X | — | 89 | 432 | 51 | 350 | 3 | X |
| | 5 | X | — | 90 | 598 | 41 | 430 | 3 | X |
| | 6 | X | 0.1(Cr) | 95 | 552 | 72 | 350 | 3 | X |
| | 7 | X | — | 85 | 510 | 25 | 350 | 3 | X |
| | 8 | X | 0.05(Ti) | 52 | 723 | 29 | 350 | 3 | X |
| | 9 | X | — | 39 | 700 | 45 | 350 | 3 | X |
| | 10 | X | 0.05(Zr) | 42 | 720 | 45 | 350 | 3 | X |
| | 11 | X | — | 43 | 710 | 43 | 350 | 3 | X |
| | 12 | X | 0.2(Zr) | 45 | 750 | 30 | 350 | 3 | X |
| | 13 | X | — | 49 | 700 | 23 | 350 | 3 | X |
| | 14 | X | 0.2(Si), 0.1(Ti) | 41 | 780 | 28 | 350 | 3 | X |
| | 15 | X | — | 48 | 720 | 40 | 350 | 3 | X |
| | 16 | X | 0.1(Ti) | 52 | 750 | 39 | 350 | 3 | X |
| | 17 | X | — | 15 | 980 | 15 | 350 | 4 | X |
| | 18 | X | — | 38 | 1420 | 2 | 350 | 7 | X |
| | 19 | X | — | 12 | 1205 | 8 | 350 | 6 | X |
| | 20 | X | — | 13 | 1063 | 15 | 350 | 5 | X |
| | 21 | X | — | 13 | 1059 | 12 | 350 | 5 | X |
| | 22 | X | — | 12 | 1059 | 12 | 350 | 5 | X |
| | 23 | X | — | — | — | — | — | — | — |

"#" means that the chemical composition is out of the range regulated by the present invention.
"*" means that the production condition is out of the range regulated by the present invention.
"h" in "Time" means hour.
"X" in ① means that none of relations regulated by formulas (1), (2) and (3) is satisfied.
② means "content maximum value/content minimum value". Object element is shown in parentheses.

In the "Evaluation" column of bending workability of the tables, "○" shows those satisfying B≤2.0 in plate materials having tensile strength TS of 800 MPa or less and those satisfying the following formula (b) in plate materials having tensile strength TS exceeding 800 MPa, "x" shows those that are not satisfactory.

$$B \leq 41.2686 - 39.4583 \times \exp[-\{(TS-615.675)/2358.08\}^2] \quad (b)$$

Figure 6:
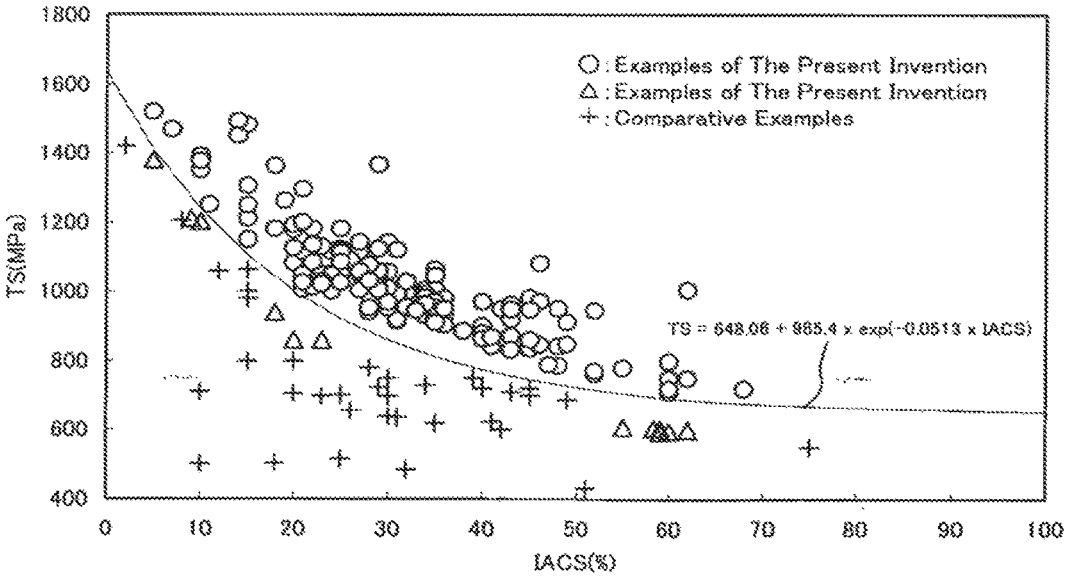
FIG. 6: A view showing the relationship between the tensile strength and the electric conductivity of each of examples.

FIG. 6 is a view showing the relation between tensile strength and electric conductivity in each example. In FIG. 6, the values of Inventive Examples in Examples 1 and 2 are plotted.

As shown in Tables. 5 to 9 and FIG. 6, regarding the chemical composition, the concentration ratio and the total number of the precipitates and the intermetallics are within the ranges regulated by the present invention in Inventive Examples 1 to 145 and the tensile strength and the electric conductivity satisfied the above formula (a). Accordingly, it can be said that the balance between electric conductivity and tensile strength of these alloys are of a level equal to or higher than that of the Be-added copper alloy. In Inventive Examples 121 to 131, the addition quantity and/or manufacturing condition were minutely adjusted with the same component system. It can be said that these alloys have a relationship between tensile strength and electric conductivity as shown by "▲" in FIG. 6, and also have the characteristics of the conventionally known copper alloy. Thus, the copper alloy disclosed herein is found to be rich in variations of tensile strength and electric conductivity. Further, the heat resisting temperature was kept in a high level of 500° C. Therefore the bending property was also satisfactory.

On the other hand, Comparative Examples 1 to 4 and 17 to 23 were inferior in bending workability, in which the content of any one of Cr, Ti and Zr is out of the range regulated by the present invention. Particularly, the electric conductivity in Comparative Examples 17 to 23 was low since the total content of elements of the groups (a) to (f) was also out of the range regulated by the present invention.

Comparative Examples 5 to 16 are examples of the alloy having the chemical composition disclosed herein. However, the cooling rate after casting is low in 5, 7, 9, 11, 13 and 15, and the bending workability was inferior in Comparative Examples 6, 8, 10, 12, 14 and 16, where the concentration ratio and the number of the precipitates and the intermetallics are out of the ranges disclosed herein due to the solution treatment. Further, the alloys in Comparative Examples involving solution treatment were inferior in tensile strength and electric conductivity, compared with those of the present disclosure having the same chemical composition (Inventive Examples 5, 21, 37, 39, 49 and 85).

For Comparative Examples 2 and 23, the characteristics could not be evaluated since edge cracking in the second rolling was too serious to collect the samples.

Example 2

In order to examine the influence of the process, copper alloys having chemical compositions of Nos. 67, 114 and 127 shown in Tables 2 through 4 were melted in a high frequency furnace followed by casting in a ceramic mold, whereby slabs of thickness 12 mm× width 100 mm× length 130 mm were obtained. Each slab was then cooled in the same manner as Example 1 in order to determine an average cooling rate from the solidification starting temperature to 450° C. A specimen was produced from this slab under the conditions shown in Tables 10 to 12. The resulting specimen was examined for the total number of the precipitates and the intermetallics, tensile strength, electric conductivity, heat resisting temperature and bending workability. These results are also shown in Tables 10 to 12.

TABLE 10

| | | | Production Condition | | | | | | | | | | |
|---|---|---|---|---|---|---|---|---|---|---|---|---|---|
| | | | Colling | 1st Rolling | | 1st Heat Treatment | | | 2nd Rolling | | 2nd Heat Treatment | | |
| Division | | Alloy No. | Rate (° C./s) | Temp. (° C.) | Thickness (mm) | Temp. (° C.) | Time | At-mosphere | Temp. (° C.) | Thickness (mm) | Temp. (° C.) | Time | Atmosphere |
| Examples of The Present Invention | 146 | 67 | 0.5 | 25 | 8.0 | 400 | 2 h | Ar | 25 | 0.8 | 350 | 10 h | Ar |
| | 147 | 67 | 2.0 | 25 | 7.8 | 400 | 2 h | Ar | 25 | 0.6 | 350 | 10 h | Ar |
| | 148 | 67 | 10.0 | 25 | 8.0 | 400 | 2 h | Ar | 25 | 1.5 | 350 | 10 h | Ar |
| | 149 | 67 | 0.5 | 25 | 5.1 | 400 | 2 h | Ar | 25 | 0.7 | 350 | 10 h | Ar |
| | 150 | 67 | 2.0 | 25 | 4.9 | 400 | 2 h | Ar | 25 | 0.5 | 350 | 10 h | Ar |
| | 151 | 67 | 10.0 | 25 | 4.9 | 400 | 2 h | Ar | 25 | 0.3 | 350 | 10 h | Ar |
| | 152 | 67 | 5.0 | 25 | 0.6 | 400 | 2 h | Ar | 25 | 0.2 | 350 | 10 h | Ar |
| | 153 | 67 | 0.5 | 25 | 0.6 | 400 | 2 h | Ar | 25 | 0.2 | 350 | 10 h | Ar |
| | 154 | 67 | 0.5 | 25 | 0.6 | 400 | 2 h | Ar | 200 | 0.2 | 350 | 10 h | Ar |
| | 155 | 67 | 0.5 | 25 | 0.6 | 400 | 2 h | Ar | 250 | 0.2 | 350 | 10 h | Ar |
| | 156 | 67 | 0.5 | 25 | 0.6 | 400 | 2 h | Ar | 250 | 0.2 | 350 | 10 h | Ar |
| | 157 | 67 | 2.0 | 25 | 0.6 | 400 | 2 h | Ar | 25 | 0.2 | 400 | 1 h | Ar |
| | 158 | 67 | 10.0 | 25 | 0.6 | 400 | 2 h | Ar | 200 | 0.2 | 350 | 10 h | Ar |
| | 159 | 67 | 10.0 | 25 | 0.6 | 400 | 2 h | Vacuum | 200 | 0.1 | 300 | 20 h | Ar |
| | 160 | 67 | 10.0 | 50 | 0.6 | 400 | 2 h | Vacuum | 200 | 0.1 | 400 | 30 m | Ar |
| | 161 | 67 | 10.0 | 100 | 0.6 | 400 | 2 h | Vacuum | 200 | 0.1 | 350 | 10 h | Ar |
| | 162 | 67 | 10.0 | 350 | 0.6 | 400 | 2 h | Vacuum | 250 | 0.1 | 350 | 10 h | Ar |
| | 163 | 67 | 10.0 | 450 | 0.6 | 400 | 2 h | Vacuum | 25 | 0.1 | 350 | 10 h | Vacuum |
| | 164 | 67 | 10.0 | 25 | 0.6 | 550 | 10 m | Ar | 25 | 0.1 | 400 | 2 h | Vacuum |
| | 165 | 67 | 10.0 | 25 | 0.6 | 500 | 10 m | Ar | 25 | 0.1 | 400 | 30 m | Vacuum |
| | 166 | 67 | 10.0 | 25 | 0.6 | 350 | 72 h | Ar | 200 | 0.1 | 350 | 10 h | Ar |
| | 167 | 67 | 10.0 | 25 | 0.6 | 280 | 72 h | Ar | 25 | 0.1 | 350 | 10 h | Ar |
| | 168 | 114 | 0.5 | 25 | 8.0 | 400 | 2 h | Ar | 25 | 1.6 | 350 | 10 h | Ar |
| | 169 | 114 | 2.0 | 25 | 7.8 | 400 | 2 h | Ar | 25 | 0.7 | 350 | 10 h | Vacuum |
| | 170 | 114 | 10.0 | 25 | 8.0 | 400 | 2 h | Ar | 25 | 0.6 | 350 | 10 h | Ar |
| | 171 | 114 | 0.5 | 25 | 5.1 | 400 | 2 h | Ar | 25 | 1.1 | 350 | 10 h | Ar |
| | 172 | 114 | 2.0 | 25 | 4.9 | 400 | 2 h | Ar | 25 | 0.4 | 325 | 18 h | Ar |
| | 173 | 114 | 10.0 | 25 | 4.9 | 400 | 2 h | Ar | 25 | 1.2 | 300 | 24 h | Ar |
| | 174 | 114 | 5.0 | 25 | 0.6 | 400 | 2 h | Ar | 25 | 0.2 | 350 | 10 h | Ar |
| | 175 | 114 | 0.5 | 25 | 0.6 | 400 | 2 h | Ar | 25 | 0.2 | 350 | 10 h | Ar |

TABLE 10-continued

| Division | | Production Condition: 3rd Rolling Temp. (° C.) | 3rd Rolling Thickness (mm) | 3rd Heat Treatment Temp. (° C.) | 3rd Heat Treatment Time | 3rd Heat Treatment Atmosphere | ① | Characteristics: Grain Size (μm) | Tensile Strength (MPa) | Conductivity (%) | Heat Resisting Temp. (° C.) | Bending Workability B (R/t) | Bending Workability Evaluation |
|---|---|---|---|---|---|---|---|---|---|---|---|---|---|
| Examples of The Present Invention | 146 | — | — | — | — | — | ◎ | 15 | 950 | 35 | 500 | 2 | ○ |
| | 147 | — | — | — | — | — | ◎ | 23 | 921 | 38 | 500 | 2 | ○ |
| | 148 | — | — | — | — | — | ◎ | 15 | 915 | 36 | 500 | 2 | ○ |
| | 149 | — | — | — | — | — | ◎ | 8 | 1048 | 30 | 500 | 8 | ○ |
| | 150 | — | — | — | — | — | ◎ | 4 | 1055 | 23 | 500 | 8 | ○ |
| | 151 | — | — | — | — | — | ◎ | 7 | 1060 | 25 | 500 | 3 | ○ |
| | 152 | — | — | — | — | — | ◎ | 16 | 953 | 32 | 400 | 2 | ○ |
| | 153 | — | — | — | — | — | ◎ | 3 | 1052 | 24 | 500 | 8 | ○ |
| | 154 | 25 | 0.1 | 300 | 1 h | Ar | ◎ | 2 | 1148 | 15 | 500 | 8 | ○ |
| | 155 | 200 | 0.1 | 300 | 2 h | Ar | ◎ | 2 | 1150 | 15 | 500 | 8 | ○ |
| | 156 | 25 | 0.1 | 280 | 8 h | Ar | ◎ | 5 | 1082 | 20 | 500 | 8 | ○ |
| | 157 | — | — | — | — | — | ◎ | 4 | 1050 | 25 | 500 | 8 | ○ |
| | 158 | — | — | — | — | — | ◎ | 0.9 | 1115 | 21 | 500 | 8 | ○ |
| | 159 | — | — | — | — | — | ◎ | 1 | 1115 | 24 | 500 | 8 | ○ |
| | 160 | — | — | — | — | — | ◎ | 0.9 | 1116 | 25 | 500 | 8 | ○ |
| | 161 | — | — | — | — | — | ◎ | 0.9 | 1115 | 27 | 500 | 8 | ○ |
| | 162 | — | — | — | — | — | ◎ | 2 | 1110 | 25 | 500 | 8 | ○ |
| | 163 | — | — | — | — | — | ◎ | 18 | 952 | 28 | 500 | 2 | ○ |
| | 164 | — | — | — | — | — | ◎ | 5 | 1001 | 24 | 500 | 2 | ○ |
| | 165 | — | — | — | — | — | ◎ | 3 | 1048 | 23 | 500 | 8 | ○ |
| | 166 | — | — | — | — | — | ○ | 0.5 | 1249 | 15 | 500 | 8 | ○ |
| | 167 | — | — | — | — | — | ◎ | 15 | 952 | 30 | 500 | 2 | ○ |
| | 168 | — | — | — | — | — | ◎ | 23 | 812 | 48 | 500 | 2 | ○ |
| | 169 | — | — | — | — | — | ◎ | 24 | 838 | 43 | 500 | 2 | ○ |
| | 170 | — | — | — | — | — | ◎ | 21 | 831 | 45 | 500 | 2 | ○ |
| | 171 | — | — | — | — | — | ◎ | 15 | 905 | 37 | 500 | 2 | ○ |
| | 172 | — | — | — | — | — | ◎ | 14 | 925 | 38 | 500 | 2 | ○ |
| | 173 | — | — | — | — | — | ◎ | 16 | 953 | 39 | 500 | 2 | ○ |
| | 174 | — | — | — | — | — | ◎ | 23 | 847 | 46 | 400 | 2 | ○ |
| | 175 | — | — | — | — | — | ◎ | 5 | 1014 | 29 | 500 | 2 | ○ |

"h" and "m" in "Time" mean hour and minute, respectively.

"Ar" in "Atmosphere" means argon gas atmosphere, and "Vacuum" means aging in vacuum at 18.8 Pa.

"○" and "◎" in ① mean that formulas (2) and (3) are satisfied, respectively.

TABLE 11

| Division | | Alloy No. | Production Condition: Colling Rate (° C./s) | 1st Rolling Temp. (° C.) | 1st Rolling Thickness (mm) | 1st Heat Treatment Temp. (° C.) | 1st Heat Treatment Time | 1st Heat Treatment At-mosphere | 2nd Rolling Temp. (° C.) | 2nd Rolling Thickness (mm) | 2nd Heat Treatment Temp. (° C.) | 2nd Heat Treatment Time | 2nd Heat Treatment Atmosphere |
|---|---|---|---|---|---|---|---|---|---|---|---|---|---|
| Examples of The Present Invention | 176 | 114 | 0.5 | 25 | 0.6 | 400 | 2 h | Ar | 25 | 0.2 | 850 | 10 h | Vacuum |
| | 177 | 114 | 0.5 | 25 | 0.6 | 400 | 2 h | Ar | 25 | 0.2 | 350 | 10 h | Vacuum |
| | 178 | 114 | 0.5 | 25 | 0.6 | 400 | 2 h | Ar | 25 | 0.2 | 350 | 10 h | Ar |
| | 179 | 114 | 2.0 | 25 | 0.6 | 400 | 2 h | Ar | 25 | 0.2 | 400 | 1 h | Ar |
| | 180 | 114 | 10.0 | 25 | 0.6 | 400 | 2 h | Ar | 25 | 0.2 | 350 | 10 h | Ar |
| | 181 | 114 | 10.0 | 25 | 0.6 | 400 | 2 h | Vacuum | 25 | 0.1 | 300 | 20 h | Ar |
| | 182 | 114 | 10.0 | 50 | 0.6 | 400 | 2 h | Vacuum | 25 | 0.1 | 400 | 30 m | Ar |
| | 183 | 114 | 10.0 | 100 | 0.6 | 400 | 2 h | Vacuum | 25 | 0.1 | 850 | 10 h | Vacuum |
| | 184 | 114 | 10.0 | 350 | 0.6 | 400 | 2 h | Vacuum | 25 | 0.1 | 350 | 10 h | Ar |
| | 185 | 114 | 10.0 | 450 | 0.6 | 400 | 2 h | Vacuum | 25 | 0.1 | 850 | 10 h | Ar |
| | 186 | 114 | 10.0 | 25 | 0.6 | 550 | 10 m | Ar | 25 | 0.1 | 400 | 2 h | Ar |
| | 187 | 114 | 10.0 | 25 | 0.6 | 500 | 10 m | Ar | 25 | 0.1 | 400 | 30 m | Ar |
| | 188 | 114 | 10.0 | 25 | 0.6 | 850 | 72 h | Ar | 200 | 0.1 | 350 | 10 h | Ar |
| | 189 | 114 | 10.0 | 25 | 0.6 | 850 | 72 h | Ar | 200 | 0.1 | — | — | — |
| | 190 | 114 | 10.0 | 25 | 0.6 | 280 | 72 h | Ar | 25 | 0.1 | 350 | 10 h | Ar |
| | 191 | 127 | 0.5 | 25 | 7.9 | 400 | 2 h | Ar | 25 | 0.7 | 850 | 10 h | Vacuum |
| | 192 | 127 | 2.0 | 25 | 7.9 | 400 | 2 h | Ar | 25 | 1.8 | 350 | 10 h | Vacuum |
| | 193 | 127 | 10.0 | 25 | 7.8 | 400 | 2 h | Ar | 25 | 0.9 | 850 | 10 h | Ar |
| | 194 | 127 | 0.5 | 25 | 5.0 | 400 | 2 h | Ar | 25 | 0.5 | 850 | 10 h | Ar |
| | 195 | 127 | 2.0 | 25 | 5.0 | 400 | 2 h | Ar | 25 | 0.4 | 325 | 18 h | Ar |
| | 196 | 127 | 10.0 | 25 | 4.9 | 400 | 2 h | Ar | 25 | 1.0 | 300 | 24 h | Ar |
| | 197 | 127 | 0.2 | 25 | 0.6 | 400 | 2 h | Ar | 25 | 0.2 | 350 | 10 h | Ar |
| | 198 | 127 | 0.5 | 25 | 0.6 | 400 | 2 h | Ar | 25 | 0.2 | 350 | 10 h | Ar |
| | 199 | 127 | 0.5 | 25 | 0.6 | 400 | 2 h | Ar | 200 | 0.2 | 350 | 10 h | Ar |
| | 200 | 127 | 0.5 | 25 | 0.6 | 400 | 2 h | Ar | 200 | 0.2 | 350 | 10 h | Ar |
| | 201 | 127 | 0.5 | 25 | 0.5 | 400 | 2 h | Ar | 200 | 0.2 | 350 | 10 h | Ar |

TABLE 11-continued

| | | | | | | | | | | | | |
|---|---|---|---|---|---|---|---|---|---|---|---|---|
| | 202 | 127 | 0.5 | 25 | 0.6 | 400 | 2 h | Ar | 25 | 0.2 | 850 | 10 h | Ar |
| | 203 | 127 | 2.0 | 25 | 0.6 | 400 | 2 h | Ar | 25 | 0.2 | 400 | 1 h | Ar |
| | 204 | 127 | 10.0 | 25 | 0.6 | 400 | 2 h | Ar | 25 | 0.2 | 850 | 10 h | Ar |
| | 205 | 127 | 10.0 | 25 | 0.6 | 400 | 2 h | Vacuum | 25 | 0.1 | 300 | 20 h | Ar |

| | | Production Condition | | | | | | Characteristics | | | | | |
|---|---|---|---|---|---|---|---|---|---|---|---|---|---|
| | | 3rd Rolling | | 3rd Heat Treatment | | | | Grain | Tensile | | Heat Resisting | Bending Workability | |
| Division | | Temp. (° C.) | Thickness (mm) | Temp. (° C.) | Time | Atmosphere | ① | Size (μm) | Strength (MPa) | Conductivity (%) | Temp. (° C.) | B (R/t) | Evaluation |
| Examples of The Present Invention | 176 | 25 | 0.1 | 800 | 1 h | Ar | ◎ | 1 | 1076 | 28 | 500 | 8 | ○ |
| | 177 | 25 | 0.1 | 800 | 2 h | Ar | ◎ | 2 | 1091 | 26 | 500 | 3 | ○ |
| | 178 | 25 | 0.1 | 280 | 8 h | Ar | ◎ | 15 | 952 | 35 | 500 | 2 | ○ |
| | 179 | — | — | — | — | — | ◎ | 17 | 962 | 34 | 500 | 2 | ○ |
| | 180 | — | — | — | — | — | ◎ | 6 | 1046 | 24 | 500 | 3 | ○ |
| | 181 | — | — | — | — | — | ◎ | 5 | 1025 | 25 | 500 | 2 | ○ |
| | 182 | — | — | — | — | — | ◎ | 6 | 1027 | 22 | 500 | 2 | ○ |
| | 183 | — | — | — | — | — | ◎ | 7 | 1029 | 23 | 500 | 2 | ○ |
| | 184 | — | — | — | — | — | ◎ | 3 | 1049 | 21 | 500 | 2 | ○ |
| | 185 | — | — | — | — | — | ◎ | 27 | 840 | 48 | 500 | 2 | ○ |
| | 186 | — | — | — | — | — | ◎ | 15 | 968 | 30 | 500 | 2 | ○ |
| | 187 | — | — | — | — | — | ◎ | 12 | 964 | 34 | 500 | 2 | ○ |
| | 188 | — | — | — | — | — | ◎ | 2 | 1142 | 27 | 500 | 3 | ○ |
| | 189 | — | — | — | — | — | ◎ | 0.5 | 1005 | 21 | 450 | 2 | ○ |
| | 190 | — | — | — | — | — | ◎ | 21 | 847 | 49 | 500 | 2 | ○ |
| | 191 | — | — | — | — | — | ◎ | 25 | 858 | 43 | 500 | 2 | ○ |
| | 192 | — | — | — | — | — | ◎ | 22 | 849 | 44 | 500 | 2 | ○ |
| | 193 | — | — | — | — | — | ◎ | 28 | 855 | 47 | 500 | 2 | ○ |
| | 194 | — | — | — | — | — | ◎ | 26 | 944 | 38 | 500 | 2 | ○ |
| | 195 | — | — | — | — | — | ◎ | 12 | 945 | 38 | 500 | 2 | ○ |
| | 196 | — | — | — | — | — | ◎ | 5 | 980 | 29 | 500 | 2 | ○ |
| | 197 | — | — | — | — | — | ◎ | 17 | 945 | 33 | 350 | 2 | ○ |
| | 198 | — | — | — | — | — | ◎ | 6 | 1085 | 25 | 500 | 3 | ○ |
| | 199 | 25 | 0.1 | 300 | 1 h | Ar | ◎ | 4 | 1112 | 25 | 500 | 8 | ○ |
| | 200 | 25 | 0.15 | — | — | — | ◎ | 1 | 1012 | 22 | 450 | 2 | ○ |
| | 201 | 250 | 0.1 | 300 | 2 h | Vacuum | ◎ | 2 | 1125 | 20 | 500 | 8 | ○ |
| | 202 | 25 | 0.1 | 280 | 8 h | Ar | ◎ | 6 | 1022 | 23 | 500 | 2 | ○ |
| | 203 | — | — | — | — | — | ◎ | 5 | 1026 | 21 | 500 | 2 | ○ |
| | 204 | — | — | — | — | — | ◎ | 8 | 1083 | 22 | 500 | 8 | ○ |
| | 205 | — | — | — | — | — | ◎ | 5 | 1058 | 27 | 500 | 8 | ○ |

"h" and "m" in "Time" mean hour and minute, respectively.

"Ar" in "Atmosphere" means argon gas atmosphere, and "Vacuum" means aging in vacuum at 13.3 Pa.

"◎" in ① means that formula (3) is satisfied.

TABLE 12

| | | | Production Condition | | | | | | | | | | |
|---|---|---|---|---|---|---|---|---|---|---|---|---|---|
| | | | Colling | 1st Rolling | | 1st Heat Treatment | | | 2nd Rolling | | 2nd Heat Treatment | | |
| Division | | Alloy No. | Rate (° C./s) | Temp. (° C.) | Thickness (mm) | Temp. (° C.) | Time | Atmosphere | Temp. (° C.) | Thickness (mm) | Temp. (° C.) | Time | Atmosphere |
| Examples of The Present Invention | 206 | 87 | 10.5 | 25 | 1.0 | 850 | 24 h | Vacuum | 250 | 0.1 | 620 | 2 m | Ar |
| | 207 | 87 | 25.1 | 100 | 2.0 | 300 | 72 h | Ar | 25 | 0.2 | 400 | 1 h | Ar |
| | 208 | 87 | 15.2 | 25 | 3.2 | 400 | 5 h | Ar | 25 | 0.2 | 550 | 10 m | Vacuum |
| | 209 | 87 | 9.8 | 600 | 2.5 | 370 | 10 h | Ar | 25 | 0.1 | 500 | 20 m | Ar |
| | 210 | 87 | 10.5 | 250 | 2.0 | 320 | 36 h | Ar | 400 | 0.2 | 450 | 30 m | Ar |
| | 211 | 127 | 10.0 | 50 | 0.6 | 400 | 2 h | Vacuum | 200 | 0.1 | 400 | 30 m | Ar |
| | 212 | 127 | 10.0 | 100 | 0.6 | 400 | 2 h | Vacuum | 200 | 0.1 | 350 | 10 h | Ar |
| | 213 | 127 | 10.0 | 350 | 0.6 | 400 | 2 h | Vacuum | 25 | 0.1 | 350 | 10 h | Ar |
| | 214 | 127 | 10.0 | 450 | 0.6 | 400 | 2 h | Vacuum | 25 | 0.1 | 350 | 10 h | Ar |
| | 215 | 127 | 10.0 | 25 | 0.6 | 550 | 10 m | Ar | 25 | 0.1 | 400 | 2 h | Ar |
| | 216 | 127 | 10.0 | 25 | 0.6 | 500 | 10 m | Ar | 25 | 0.1 | 400 | 30 m | Ar |
| | 217 | 127 | 10.0 | 25 | 0.6 | 350 | 72 h | Ar | 25 | 0.1 | 350 | 10 h | Ar |
| | 218 | 127 | 10.0 | 25 | 0.6 | 280 | 72 h | Ar | 25 | 0.1 | 350 | 10 h | Ar |
| Comparative Examples | 24 | 67 | 0.2* | 25 | 7.9 | 400 | 2 h | Ar | 25 | 0.8 | 350 | 10 h | Vacuum |
| | 25 | 67 | 0.2* | 25 | 5.0 | 400 | 2 h | Ar | 25 | 0.5 | 850 | 10 h | Vacuum |
| | 26 | 114 | 0.2* | 25 | 7.9 | 400 | 2 h | Ar | 25 | 1.6 | 350 | 10 h | Ar |
| | 27 | 114 | 0.2* | 25 | 5.0 | 400 | 2 h | Ar | 25 | 0.8 | 350 | 10 h | Ar |
| | 28 | 127 | 0.2* | 25 | 8.0 | 400 | 2 h | Ar | 25 | 1.0 | 850 | 10 h | Ar |
| | 29 | 127 | 0.2* | 25 | 5.0 | 400 | 2 h | Ar | 25 | 0.7 | 350 | 10 h | Ar |
| | 30 | 67 | 10.5 | 650* | 1.0 | 400 | 2 h | Vacuum | 620* | 0.1 | 350 | 4 h | Ar |

TABLE 12-continued

| | | | | | | | | | | | | | |
|---|---|---|---|---|---|---|---|---|---|---|---|---|---|
| 31 | 114 | 9.8 | 700* | 0.8 | 450 | 30 m | Ar | 25 | 0.2 | 350 | 10 h | Ar |
| 32 | 127 | 13.2 | 25 | 2.0 | 400 | 2 h | Ar | 650* | 0.1 | 400 | 30 m | Ar |
| 33 | 67 | 9.5 | 25 | 1.1 | 800* | 10 s* | Ar | 25 | 0.1 | 350 | 10 h | Ar |
| 34 | 114 | 10.2 | 25 | 1.2 | 400 | 2 h | Ar | 25 | 0.2 | 790* | 10 s* | Ar |
| 35 | 127 | 9.8 | 25 | 1.1 | 850* | 15 s* | Ar | 25 | 0.1 | 800* | 15 s* | Ar |
| 36 | 114 | 10.2 | 25 | 1.0 | 400 | 2 h | Ar | 25 | 0.1 | 100* | 24 h | Ar |

| | | Production Condition | | | | | | Characteristics | | | | | |
|---|---|---|---|---|---|---|---|---|---|---|---|---|---|
| | | 3rd Rolling | | 3rd Heat Treatment | | | | | | | Heat Resisting | Bending Workability | |
| Division | | Temp. (° C.) | Thickness (mm) | Temp. (° C.) | Time | Atmosphere | ① | Grain Size (μm) | Tensile Strength (MPa) | Conductivity (%) | Temp. (° C.) | B (R/t) | Evaluation |
| Examples of The Present Invention | 206 | — | — | — | — | — | ◎ | 10 | 1045 | 29 | 450 | 2 | ○ |
| | 207 | 25 | 0.1 | 570 | 5 m | Ar | ◎ | 15 | 1112 | 25 | 450 | 1 | ○ |
| | 208 | — | — | — | — | — | ◎ | 8 | 1052 | 30 | 450 | 1 | ○ |
| | 209 | — | — | — | — | — | ◎ | 12 | 1022 | 32 | 450 | 2 | ○ |
| | 210 | — | — | — | — | — | ◎ | 18 | 1025 | 30 | 450 | 1 | ○ |
| | 211 | — | — | — | — | — | ◎ | 1 | 1130 | 23 | 500 | 3 | ○ |
| | 212 | — | — | — | — | — | ◎ | 1 | 1184 | 22 | 500 | 3 | ○ |
| | 213 | — | — | — | — | — | ◎ | 2 | 1085 | 25 | 500 | 8 | ○ |
| | 214 | — | — | — | — | — | ◎ | 19 | 903 | 36 | 500 | 2 | ○ |
| | 215 | — | — | — | — | — | ◎ | 5 | 1004 | 29 | 500 | 2 | ○ |
| | 216 | — | — | — | — | — | ◎ | 6 | 1031 | 28 | 500 | 2 | ○ |
| | 217 | — | — | — | — | — | ○ | 0.2 | 1262 | 19 | 500 | 3 | ○ |
| | 218 | — | — | — | — | — | ◎ | 18 | 909 | 35 | 500 | 2 | ○ |
| Comparative Examples | 24 | — | — | — | — | — | X | 75 | 480 | 15 | 350 | 8 | X |
| | 25 | — | — | — | — | — | X | 85 | 782 | 22 | 350 | 3 | X |
| | 26 | — | — | — | — | — | X | 90 | 456 | 35 | 350 | 4 | X |
| | 27 | — | — | — | — | — | X | 82 | 684 | 58 | 350 | 3 | X |
| | 28 | — | — | — | — | — | X | 70 | 483 | 25 | 350 | 8 | X |
| | 29 | — | — | — | — | — | X | 42 | 705 | 16 | 350 | 3 | X |
| | 30 | — | — | — | — | — | X | 55 | 610 | 31 | 300 | 5 | X |
| | 31 | — | — | — | — | — | X | 65 | 625 | 25 | 300 | 5 | X |
| | 32 | — | — | — | — | — | X | 50 | 702 | 20 | 300 | 4 | X |
| | 33 | — | — | — | — | — | X | 70 | 650 | 60 | 300 | 4 | X |
| | 34 | — | — | — | — | — | X | 75 | 640 | 55 | 300 | 3 | X |
| | 35 | — | — | — | — | — | X | 78 | 600 | 58 | 300 | 4 | X |
| | 36 | — | — | — | — | — | X | 15 | 610 | 20 | 250 | 4 | X |

"*" means that the production condition is out of the range regulated by the present invention.
"h" and"m" in "Time" mean hour and minute, respectively.
"Ar" in "Atmosphere" means argon gas atmosphere, and "Vacuum" means aging in vacuum at 13.3 Pa.
"○" and "◎" in ① mean that formula (2) and (3) are satisfied, respectively, and "X" means that none of relations regulated by formulas (1) to (3) is satisfied.

As shown in Tables 10 to 12 and FIG. 6, in Inventive Examples 146 to 218, copper alloys having the total numbers of the precipitates and the intermetallics within the range disclosed herein could be produced, since the cooling condition, rolling condition and aging treatment condition are within the ranges disclosed herein. Therefore, in each Inventive Example, the tensile strength and the electric conductivity satisfied the above-mentioned formula (a). The heat resisting temperature was also kept at a high level, with satisfactory bending workability.

On the other hand, in Comparative Examples 24 to 36, precipitates were coarsened, and the distribution of precipitates was out of the range disclosed herein, since the cooling rate, rolling temperature and heat treatment temperature were out of the ranges disclosed herein. The bending workability was also reduced.

Example 3

Alloys having chemical compositions shown in Table 13 were melted in the atmosphere of a high frequency furnace and continuously casted in the two kinds of methods described below. The average cooling rate from the solidification starting temperature to 450° C. was controlled by an in-mold cooling or primary cooling, and a secondary cooling was using controlled a water atomization after leaving the mold. In each method, a proper amount of charcoal powder was added to the upper part of the melt during dissolving in order to lay the melt surface part in a reductive atmosphere.

<Continuous Casting Method>

(1) In the horizontal continuous casting method, the melt was pored into a holding furnace by an upper joint, a substantial amount of charcoal was thereafter similarly added in order to prevent the oxidation of the melt surface, and the slab was obtained by intermittent drawing using a graphite mold directly connected to the holding furnace. The average drawing rate was 200 mm/min.

(2) In the vertical continuous casting method, the oxidation was similarly prevented with charcoal after pouring the melt into a tundish, and the melt was continuously poured from the tundish into a melt pool in the mold through a layer covered with charcoal powder by use of a zirconia-made immersion nozzle. A copper alloy-made water-cooled mold lined with graphite 4 mm thick was used as the mold, and a continuous drawing was performed at an average rate of 150 mm/min.

The cooling rate in each method was calculated by measuring the surface temperature after leaving the mold at several points by a thermocouple, and using heat conduction calculation in combination with the result.

The resulting slab was surface-ground, and then subjected to cold rolling, heat treatment, cold rolling, and heat treatment under the conditions shown in Table 14, whereby a thin strip 200 μm thick was finally obtained. The resulting thin strip was examined for total number of the precipitates and the intermetallics, tensile strength, electric conductivity, heat resisting temperature and bending workability was examined in the same manner as described above. The results are also shown in Table 14. In Table 14, the "horizontal drawing" shows an example using the horizontal continuous casting method, and the "vertical drawing" shows an example using the vertical continuous casting method.

TABLE 13

Figure 7:
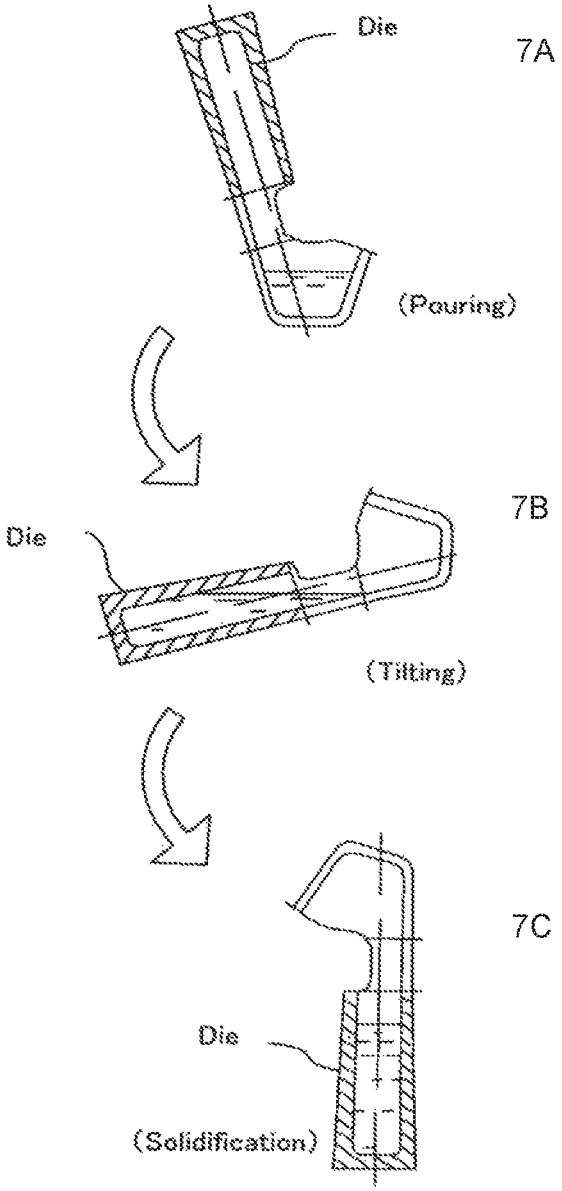
FIG. 7: A schematic view showing a casting method by the Durville process.

| Chemical Composition (mass %, Balance: Cu & Impurities) | | | | | |
|---|---|---|---|---|---|
| Cr | Ti | Zr | Sn | P | Ag |
| 1.01 | 1.49 | 0.05 | 0.4 | 0.1 | 0.2 |

charcoal powder, then tilting the die as shown in FIG. 7B, and solidifying the melt in a state shown in FIG. 7C. The die is made of cast iron with a thickness of 50 mm, and has a pipe arrangement with a cooling hole bored in the inner part so that air cooling can be performed. The bloom was made to a wedge shape having a lower section of 30×300 mm, an upper section of 50×400 mm, and a height of 700 mm so as to facilitate the pouring.

A part up to 300 mm from the lower end of the resulting bloom was prepared followed by surface-polishing, and then subjected to cold rolling (30 to 10 mm) and heat treatment (375° C.×16 h), whereby a plate 10 mm thick was obtained. Such a plate was examined for the total number of the precipitates and the intermetallics, tensile strength, electric conductivity, heat resisting temperature and bending workability by the above-mentioned method and, further, examined for wear resistance, thermal conductivity and spark generation resistance by the method described below. The results are shown in Table 15.

<Wear Resistance>

A specimen of width 10 mm× length 10 mm was prepared from each specimen, a section vertical to the rolled surface and parallel to the rolling direction was polish-finished, and

TABLE 14

| Production Condition | | | | | | | | | | |
|---|---|---|---|---|---|---|---|---|---|---|
| | Bloom | Casting | Cooling | 1st Rolling | | 1st Heat Treatment | | | 2nd Rolling | |
| Casting Method | Section (mm × mm) | Temp. (° C.) | Rate (° C./s) | Temp. (° C.) | Thickness (mm) | Temp. (° C.) | Time | Atmosphere | Temp. (° C.) | Thickness (mm) |
| Horizontal Drawing | 25 × 60 | 1350 | 25 | 25 | 2.5 | 400 | 2 h | Ar | 25 | 0.2 |
| Vertical Drawing | 65 × 300 | 1340 | 5 | 280 | 5 | 400 | 2 h | Ar | 200 | 0.2 |

| Production Condition | | | | Characteristics | | | | | | |
|---|---|---|---|---|---|---|---|---|---|---|
| | 2nd Heat Treatment | | | | Grain | Tensile | | Heat Resisting | Bonding Workability | |
| Casting Method | Temp. (° C.) | Time | Atmosphere | ① | Size (μm) | Strength (MPa) | Conductivity (%) | Temp. (° C.) | B (R/t) | Evaluation |
| Horizontal Drawing | 350 | 4 h | Ar | ◎ | 5 | 1180 | 40 | 500 | 1 | ○ |
| Vertical Drawing | 350 | 4 h | Ar | ○ | 2 | 1250 | 42 | 500 | 1 | ○ |

"○" and "◎" in ① mean that formulas (2) and (3) are satisfied, respectively.

As shown in Table 14, in each casting method, the alloys with high tensile strength and electric conductivity could be obtained, which proved that the method of the present invention is applicable to a practical casting machine.

Example 4

In order to evaluate the application to the safety tools, samples were prepared by the following method, and evaluated for wear resistance (Vickers hardness) and spark resistance.

Alloys shown in Table 15 were melted in a high frequency furnace in the atmosphere, and die-cast by the Durville process. Namely, each bloom was produced by holding a die in a state as shown in FIG. 7A, pouring a melt of about 1300° C. into the die while ensuring a reductive atmosphere by the Vickers hardness at 25° C. and load 9.8N thereof was measured by the method regulated in JIS Z 2244.

<Thermal Conductivity>

Figure 5:
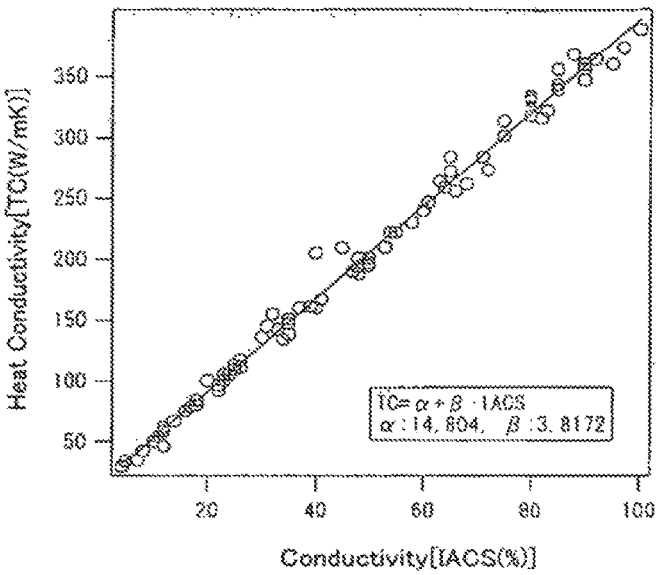
FIG. 5: A view showing the relationship between the electric conductivity and thermal conductivity.

The thermal conductivity [TC (W/m·K)] was determined by the use of the electric conductivity [IACS (%)] from the formula described in FIG. 5: TC=14.804+3.8172×IACS.

<Spark Generation Resistance>

A spark resistance test according to the method regulated in JIS G 0566 was performed by use of a table grinder having a rotating speed of 12000 rpm, and the spark generation was visually confirmed.

The average cooling rate from the solidification starting temperature to 450° C. based on the heat conduction calculation with the temperature measured by inserting a thermocouple to a position of 5 mm under the mold inner wall surface in a position 100 mm from the lower section, was determined to be 10° C./s.

TABLE 15

| Division | | Composition (wt %) Cr | Ti | Zr | Sn | P | Ag | ① | Grain Size (μm) | Tensile Strength (MPa) | Conductivity (%) |
|---|---|---|---|---|---|---|---|---|---|---|---|
| Examples of | 219 | 1.5 | 0.8 | 1.00 | 1.00 | 0.01 | 0.10 | ◎ | 25 | 920 | 42 |
| The Present | 220 | 1.0 | 1.5 | — | 0.40 | — | — | ○ | 12 | 1204 | 28 |
| Invention | 221 | 0.5 | 1.0 | 0.01 | 0.80 | 0.02 | 0.80 | ◎ | 20 | 989 | 40 |
| | 222 | 1.0 | 1.0 | 0.60 | 0.50 | 0.05 | 0.30 | ◎ | 18 | 1006 | 30 |
| Comparative | 37 | — | 6.00 | 5.20 | — | 0.10 | 0.50 | X | 2 | 1398 | 1 |
| Examples | 38 | 5.00 | 0.05 | 5.5 | 0.10 | 0.10 | — | X | 1 | 1312 | 1 |

| Division | | Heat Resisting Temp. (° C.) | Bending Workability B (R/t) | Bending Workability Evaluation | Wear Resistence (Hv) | Heat Conductivity (W/m · K) | Generation of Sparks |
|---|---|---|---|---|---|---|---|
| Examples of | 219 | 400 | 1 | ○ | 287 | 175 | Non |
| The Present | 220 | 450 | 2 | ○ | 369 | 122 | Non |
| Invention | 221 | 450 | 1 | ○ | 807 | 167 | Non |
| | 222 | 450 | 2 | ○ | 312 | 129 | Non |
| Comparative | 37 | 350 | 6 | X | 425 | 19 | Generated |
| Examples | 38 | 350 | 6 | X | 400 | 20 | Generated |

"○" and "◎" in ① mean that formulas (2) and (3) are satisfied, respectively, and "X" means that none of relations regulated by formulas (1) to (3) is satisfied.

As shown in Table 15, no spark was observed with satisfactory wear resistance and high thermal conductivity in Inventive Examples 219 to 222. On the other hand, sparks were observed with low thermal conductivity in Comparative Examples 37 and 38, since the chemical composition regulated by the present invention was not satisfied.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention and the appended claims.

According to the present disclosure, a copper alloy containing no environmentally harmful element such as Be, which has wide product variations, and is excellent in high-temperature strength and workability, and also excellent in the performances required for safety tool materials, or thermal conductivity, wear resistance and spark generation resistance, and a method for producing the same can be provided.

The invention claimed is:

1. A copper alloy consisting of, by mass %, at least two elements selected from the group consisting of 0.01 to 5% of Cr, 0.01 to 5% of Ti and 0.01 to 5% of Zr and the balance Cu and impurities;

wherein the relationship between the total number N of precipitates and intermetallics, having a diameter of not smaller than 1 μm, which are found in 1 $mm^2$ of the alloy, and the diameter X in μm of the precipitates and the intermetallics having a diameter of not smaller than 1 μm satisfies the following formula (1);

$$\log N \leq 0.4742+17.629\times\exp(-0.1133\times X) \quad (1)$$

wherein X=1 when the measured value of the grain size of the precipitates and the intermetallics are 1.0 μm or more and less than 1.5 μm, and X=α (α is an integer of 2 or more) when the measured value is (α−0.5) μm or more and less than (α+0.5) μm.

2. The copper alloy according to claim 1, wherein the ratio of the maximum value and the minimum value of an average content of at least one alloy element in a micro area is not less than 1.5.

3. The copper alloy according to claim 1, wherein the copper alloy has a grain size of 0.01 to 35 μm.

4. The copper alloy according to claim 2, wherein the grain size is 0.01 to 35 μm.

5. A method for producing a copper alloy, comprising cooling a bloom, a slab, a billet, or a ingot obtained by melting a copper alloy according to claim 1, followed by casting in at least in a temperature range from the bloom, the slab, the billet, or the ingot temperature just after casting to 450° C. at a cooling rate of 0.5° C./s or more, so that the relationship between the total number N and the diameter X satisfies the following formula (1):

$$\log N \leq 0.4742+17.629\times\exp(-0.1133\times X) \quad (1)$$

wherein N means the total number of precipitates and intermetallics, having a diameter of not smaller than 1 μm which are found in 1 $mm^2$ of the alloy; and X means the diameter in μm of the precipitates and the intermetallics having a diameter of not smaller than 1 μm.

6. The method for producing a copper alloy according to claim 5, further comprising performing working in a temperature range of 600° C. or lower.

7. The method for producing a copper alloy according to claim 6, further comprising performing heat treatment of holding for 30 seconds or more in a temperature range of 150 to 750° C.

8. The method for producing a copper alloy according to claim 7, wherein the working in a temperature range of 600° C. or lower and the heat treatment of holding for 30 seconds or more in a temperature range of 150 to 750° C. are performed for a plurality of times.

9. The method for producing a copper alloy according to claim 7, wherein the working in a temperature range of 600° C. or lower is performed after the final heat treatment.

* * * * *